US009706608B2

(12) United States Patent
Fukano et al.

(10) Patent No.: US 9,706,608 B2
(45) Date of Patent: Jul. 11, 2017

(54) STRAIGHT TUBE LED LAMP, LAMP SOCKET SET, AND LIGHTING FIXTURE

(75) Inventors: Satoshi Fukano, Nara (JP); Nobumichi Nishihama, Nara (JP); Tadashi Yamanaka, Hyogo (JP); Fumihiko Masuko, Osaka (JP); Takeshi Saito, Hyogo (JP); Hiroki Nakagawa, Osaka (JP); Masanao Hieda, Kanagawa (JP); Kenichi Ito, Kanagawa (JP); Naoki Sugishita, Kanagawa (JP); Keisuke Ono, Kanagawa (JP); Keiichi Shimizu, Kanagawa (JP); Shinichi Kumashiro, Kanagawa (JP); Takeshi Osada, Kanagawa (JP)

(73) Assignees: PANASONIC CORPORATION, Osaka (JP); TOSHIBA LIGHTING & TECHNOLOGY CORPORATION, Kanagawa (JP)

( * ) Notice: Subject to any disclaimer, the term of this patent is extended or adjusted under 35 U.S.C. 154(b) by 615 days.

(21) Appl. No.: 13/807,039

(22) PCT Filed: Jun. 10, 2011

(86) PCT No.: PCT/JP2011/063394

§ 371 (c)(1),
(2), (4) Date: Dec. 27, 2012

(87) PCT Pub. No.: WO2012/002135

PCT Pub. Date: Jan. 5, 2012

(65) Prior Publication Data

US 2013/0119896 A1 May 16, 2013

(30) Foreign Application Priority Data

Jun. 28, 2010 (JP) ..... 2010-146280
Jun. 28, 2010 (JP) ..... 2010-146566
(Continued)

(51) Int. Cl.
*H05B 37/00* (2006.01)
*H05B 33/06* (2006.01)
(Continued)

(52) U.S. Cl.
CPC ..... *H05B 33/06* (2013.01); *F21K 9/27* (2016.08); *F21V 14/02* (2013.01); *F21V 29/50* (2015.01);
(Continued)

(58) Field of Classification Search
None
See application file for complete search history.

(56) References Cited

U.S. PATENT DOCUMENTS 8,434,891 B1 * 5/2013 Ham ..... 362/218
2002/0114156 A1 * 8/2002 Wendel et al. ..... 362/221
(Continued)

FOREIGN PATENT DOCUMENTS

CN 101740984 6/2010
JP 2002-314136 10/2002
(Continued)

OTHER PUBLICATIONS

U.S. Appl. No. 13/529,318 to Ryusuke Kotera et al., which was filed Jun. 21, 2012.
(Continued)

*Primary Examiner* — Cassandra Cox
(74) *Attorney, Agent, or Firm* — Greenblum & Bernstein, P.L.C.

(57) ABSTRACT

A straight tube LED lamp includes: a straight tube in which a plurality of light emitting diodes is housed; a first cap for forming a power feeding connection to the plurality of light emitting diodes, provided on one axial direction end side of the straight tube; and a second cap for grounding, provided on another axial direction end side of the straight tube. A first
(Continued)

terminal for forming an electrical connection to a power feeding terminal of a first lamp socket is provided in the first cap. A second terminal for forming an electrical connection to a grounding terminal of a second lamp socket is provided in the second cap.

22 Claims, 20 Drawing Sheets

(30) Foreign Application Priority Data

Jun. 28, 2010 (JP) ..... 2010-146872
Jun. 28, 2010 (JP) ..... 2010-146873
Jun. 28, 2010 (JP) ..... 2010-146874

(51) Int. Cl.

| | |
|---|---|
| ***H01R 13/717*** | (2006.01) |
| ***H01R 33/08*** | (2006.01) |
| ***H01J 5/50*** | (2006.01) |
| ***H05B 33/08*** | (2006.01) |
| ***F21V 14/02*** | (2006.01) |
| ***F21V 29/50*** | (2015.01) |
| ***F21K 9/27*** | (2016.01) |
| *H01R 33/02* | (2006.01) |
| *F21Y 103/10* | (2016.01) |
| *F21Y 115/10* | (2016.01) |

(52) U.S. Cl.
CPC ..... *H01J 5/50* (2013.01); *H01R 13/7175* (2013.01); *H01R 33/0854* (2013.01); *H05B 33/0803* (2013.01); *F21Y 2103/10* (2016.08); *F21Y 2115/10* (2016.08); *H01R 33/02* (2013.01)

(56) References Cited

U.S. PATENT DOCUMENTS

| | | | | |
|---|---|---|---|---|
| 2005/0202704 | A1 | 9/2005 | Lingemann et al. | |
| 2009/0026973 | A1 | 1/2009 | Kato et al. | |
| 2009/0068869 | A1* | 3/2009 | Brand et al. | 439/226 |
| 2009/0122543 | A1 | 5/2009 | Kuo et al. | |
| 2009/0290334 | A1 | 11/2009 | Ivey et al. | |
| 2012/0019166 | A1* | 1/2012 | Terasaka et al. | 315/294 |
| 2015/0077982 | A1* | 3/2015 | Urano et al. | 362/217.14 |

FOREIGN PATENT DOCUMENTS

| | | |
|---|---|---|
| JP | 2008-103304 | 5/2008 |
| JP | 3142652 | 6/2008 |
| JP | 2008-282793 | 11/2008 |
| JP | 2009-266432 | 11/2009 |
| JP | 2009-283230 | 12/2009 |
| KR | 10-0881902 | 1/2009 |
| TW | M333509 U | 6/2008 |
| TW | M374532 U1 | 2/2010 |
| TW | M381978 U1 | 6/2010 |
| WO | 2011/086906 | 7/2011 |

OTHER PUBLICATIONS

Extended European Search Report issued in European Patent Application No. 111800603.0, dated May 2, 2016.
Search Report (English translation) issued in Taiwanese Patent Application No. 100121315, dated Apr. 2, 2014, together with an English Summary of the Examination opinion.

* cited by examiner

STRAIGHT TUBE LED LAMP, LAMP SOCKET SET, AND LIGHTING FIXTURE

TECHNICAL FIELD

The present invention relates to a straight tube LED (light emitting diode) lamp, a lamp socket set to which the straight tube LED lamp is connected, and a lighting fixture that uses the straight tube LED lamp and the lamp socket set.

BACKGROUND ART

An LED lamp, which has a longer lifespan and consumes less power than a fluorescent lamp, has been proposed as a replacement for a fluorescent lamp to achieve reductions in power consumption and a frequency with which the lamp is replaced at the end of its life (for example, Japanese Patent Application Publication Nos. 2008-103304, 2009-266432, and 2008-282793). For example, a straight tube LED lamp serving as a replacement for a straight tube fluorescent lamp includes an elongated substrate having a length that corresponds to a fluorescent lamp, and a plurality of LEDs arranged on the substrate in its lengthwise direction. An aluminum heat sink constituting a part of an outer shell is attached to an opposite side of the substrate from the LEDs, and an increase in a temperature of the LEDs is suppressed by a heat radiation effect of the heat sink, thereby preventing a reduction in a light emission efficiency of the LEDs. Further, a lighting circuit including an AC/DC converter is built into the LED lamp, and an alternating current voltage input from a lighting fixture is converted into a direct current voltage through the lighting circuit, whereupon the direct current voltage is supplied to the LEDs in order to light the LEDs.

In this type of alternating current-lit LED lamp, the lighting circuit is built into the LED lamp, and therefore a lifespan of the lighting circuit is likely to be shortened due to heat generated by the LEDs. As a result, the lifespan of the LED lamp itself is also likely to be shortened. Further, the temperature of the LEDs may be raised by heat generated in the lighting circuit, leading to a reduction in the light emission efficiency of the LEDs. Moreover, when the lighting circuit is inbuilt, a size and a cost of the LED lamp increase. Hence, advancements have been made in the development of a direct current-lit LED lamp that is lit by providing a lighting circuit including an AC/DC converter in a lighting fixture or the like on the exterior of the lamp, for example, and supplying a direct current voltage to a cap of the LED lamp.

Incidentally, the heat sink is made of aluminum and is therefore conductive. In a condition where the LED lamp is attached to the lighting fixture, however, the heat sink is not grounded. Therefore, when a current leaks to the heat sink from an LED module or the lighting fixture, an electric shock may occur upon touching the heat sink. In a direct current-lit LED lamp in particular, a voltage to ground of the heat sink is a simple sum of a power supply voltage and a lamp voltage, which is larger than an effective value of a voltage to ground of an alternating current-lit LED lamp, and therefore the risk of an electric shock is high.

SUMMARY OF INVENTION

In consideration of the problems described above, an object of the present invention is to provide a straight tube LED lamp, a lamp socket set, and a lighting fixture with which the risk of an electric shock is low.

A straight tube LED lamp according to the present invention comprises: a straight tube in which a plurality of light emitting diodes is housed; a first cap for forming a power feeding connection to the plurality of light emitting diodes, provided on one axial direction end side of the straight tube; and a second cap for grounding, provided on another axial direction end side of the straight tube. A first terminal for forming an electrical connection to a power feeding terminal of a first lamp socket is provided in the first cap. A second terminal for forming an electrical connection to a grounding terminal of a second lamp socket is provided in the second cap.

In an embodiment, the straight tube LED lamp further comprises a conductive member, and the second terminal is electrically connected to the conductive member.

In an embodiment, the conductive member takes an elongated shape and forms a part of the straight tube.

In an embodiment, the plurality of light emitting diodes are mounted on an elongated substrate in a lengthwise direction thereof so as to form an LED module, and the conductive member is a heat sink disposed in thermal contact with the LED module.

In an embodiment, the first terminal comprises two cap pins connected respectively to a positive electrode side and a negative electrode side of a direct current power supply via the first lamp socket.

In an embodiment, the two cap pins project from the first cap at a wider interval than an interval between two cap pins prescribed for a G13 type cap.

In an embodiment, latch portions extending sideward are provided on respective tip ends of the two cap pins.

In an embodiment, the latch portions of the two cap pins are bent so as to be oriented in opposite directions to each other.

In an embodiment, the second terminal is a single cap pin.

In an embodiment, a tip end of the second terminal is formed to be long in an attachment direction to the second lamp socket.

In an embodiment, recessed portions are provided on both sides of a central portion in a diameter direction in an end surface of the first cap, and the first terminal is provided in the central portion.

In an embodiment, at least one of the first cap and the second cap is formed to cover an end portion of the straight tube in a condition where movement of the straight tube is permitted.

A lamp socket set according to the present invention comprises the first and second lamp sockets to which the straight tube LED lamp described above is attached. The first lamp socket comprises a first cap reception portion to which the first cap is attached. The second lamp socket comprises a second cap reception portion to which the second cap is attached.

In an embodiment, each of the first and second lamp sockets comprises an attachment structure for attaching the straight tube LED lamp by rotating the straight tube LED lamp.

In an embodiment, the first cap reception portion is provided with: a rotor that includes insertion grooves into which two cap pins constituting the first terminal are inserted and that rotates in accordance with rotation of the straight tube; and two power feeding contacts serving as the power feeding terminal, which are electrically connected to the cap pins when the rotor rotates. Further, the second cap reception portion is provided with: an insertion groove into which a single cap pin forming the second terminal is inserted; and a grounding contact serving as the grounding terminal, which is disposed in the insertion groove and connected to the second terminal, the second terminal being free to rotate when in contact with the grounding contact.

In an embodiment, the grounding contact is electrically connected to and mechanically holds the second terminal.

A lamp socket set according to the present invention comprises the first and second lamp sockets to which the straight tube LED lamp is attached. The first lamp socket comprises a first cap reception portion to which the first cap is attached. The second lamp socket comprises a second cap reception portion to which the second cap is attached. The first cap reception portion comprises a rotor that includes an insertion groove into which the first terminal is inserted and that rotates in accordance with rotation of the straight tube, the power feeding terminal being electrically connected to the first terminal when the rotor rotates. Projecting portions are provided in sites of the first lamp socket corresponding to the recessed portions in the first cap. The second cap reception portion is provided with: an insertion groove into which the single cap pin forming the second terminal is inserted; and a grounding contact serving as the grounding terminal, which is disposed in the insertion groove and connected to the second terminal, the second terminal being free to rotate when in contact with the grounding contact.

A lamp socket set according to the present invention comprises the first and second lamp sockets to which the straight tube LED lamp is attached. The first lamp socket is configured to restrict movement of the straight tube LED lamp in the lengthwise direction. The second lamp socket is configured to permit movement of the straight tube LED lamp in the lengthwise direction.

A lamp socket set according to the present invention comprises the first and second lamp sockets to which the straight tube LED lamp is attached. The first lamp socket comprises: an insertion portion into which the first terminal of the straight tube LED lamp can be inserted; a passage portion that communicates with the insertion portion, has a narrower width than the latch portions of the first terminal, and is formed at a dimension that allows the first terminal to pass through; and a power feeding contact serving as the power feeding terminal, which is electrically connected to the first terminal on an outer side of the passage portion through which the first terminal passes.

A lighting fixture according to the present invention comprises: a lamp socket set including the first and second lamp sockets; and a straight tube LED lamp that is attached to the lamp socket set.

BRIEF DESCRIPTION OF DRAWINGS

Preferred embodiments of the invention will now be described in further details. Other features and advantages of the present invention will become better understood with regard to the following detailed description and accompanying drawings where:

FIG. 8 shows the above straight tube LED lamp and lamp socket set according to the second embodiment, wherein

FIG. 10 shows the power feeding first lamp socket used in the second embodiment, wherein

FIG. 12 shows the grounding second lamp socket used in the second embodiment, wherein

FIG. 16 shows a grounding second lamp socket used in the above embodiment, wherein

FIG. 19 shows a lighting fixture according to a third embodiment, wherein

DESCRIPTION OF EMBODIMENTS (First Embodiment)

Figure 1:
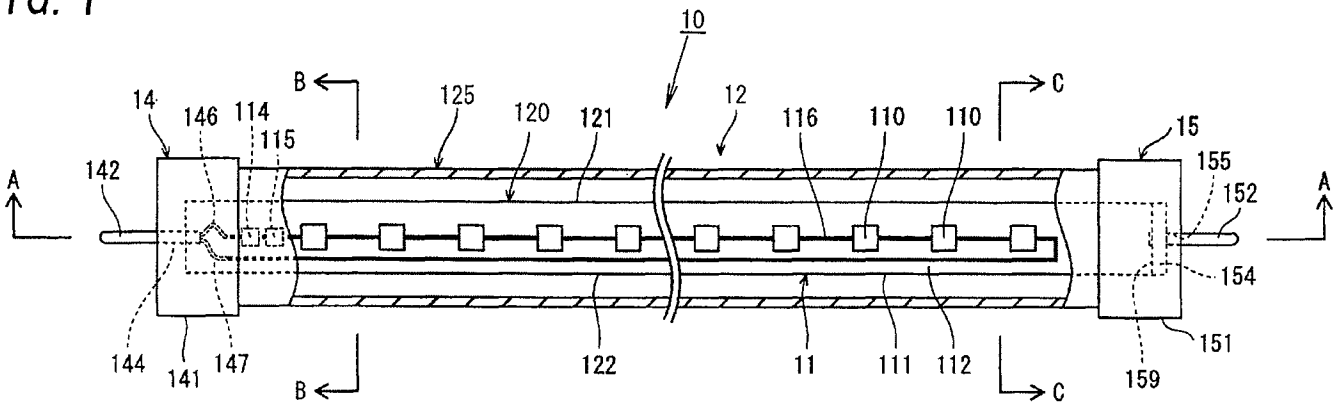
FIG. 1 is a partially cutaway plan view showing a straight tube LED lamp according to a first embodiment.
Figure 2:
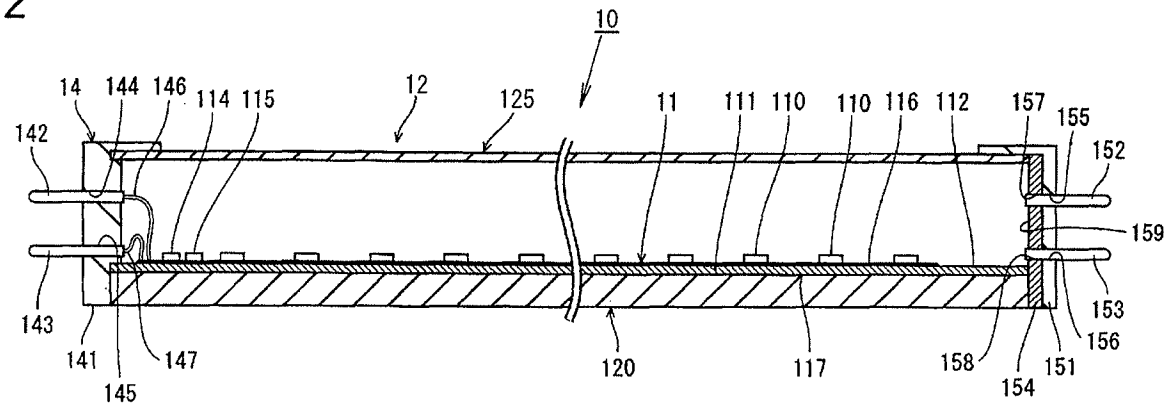
FIG. 2 is a sectional view taken along an A-A line in FIG. 1.

As shown in FIGS. 1 and 2, a straight tube LED lamp (to be referred to as a "lamp" hereafter) 10 according to this embodiment includes a straight tube 12 housing in its interior a plurality of light emitting diodes (to be referred to as "LEDs" hereafter) 110, a first cap 14 for forming a power feeding connection to the plurality of LEDs 110, and a second cap 15 for grounding. The first cap 14 is provided on one axial direction end side of the straight tube 12, while the second cap 15 is provided on another axial direction end side of the straight tube 12. The plurality of LEDs 110 are included in an LED module 11. The straight tube 12 is constituted by a heat sink 120 and a cover 125.

The LED module 11 includes an elongated rectilinear substrate 111. The plurality of LEDs 110 are mounted on a mounting surface 112 of the substrate 11, for example, in a single straight line along a lengthwise direction of the substrate 111 together with a single thermal fuse 114 and a single current fuse 115. The plurality of LEDs 110, the thermal fuse 114, and the current fuse 115 are electrically connected, for example, in series by a wiring pattern 116 formed on the mounting surface 112 of the substrate 111. A voltage of a single LED 110 is 3.3 V, for example, and therefore, when thirty LEDs 110 are mounted and connected in series, an overall lamp voltage of the lamp 10 is 3.3 V×30=99 V.

The substrate 111 may be a metal-based printed wiring board, a glass composite substrate, a glass epoxy substrate, and so on, for example. The substrate 111 preferably exhibits high thermal conductivity so that heat generated from the LEDs 110 is transmitted efficiently to the heat sink 120.

The LEDs 110 are surface mounted (SMD) white LEDs, for example. Note that the LEDs 110 are not limited to a surface mounted type, and may be formed by mounting an LED chip on the substrate 111 through flip chip-mounting or wire bonding, and sealing the LED chip with fluorescent material-dispersed resin, for example. In this case, for example, a blue light-emitting chip may be used as the LED chip, silicone resin may be used as the fluorescent material-dispersed resin, and a mixture of yellow-green fluorescent material (for example, $(Ba, Sr)_2SiO_4:Eu^{2+}$ or $Y_3(Al, Ga)_5O_{12}:Ce^{3+}$) and red fluorescent material ($Sr_2Si_5N_8:Eu^{2+}$, $(Ca, Sr)S:Eu^{2+}$, or $(Ba, Sr, Ca)AlSiN_3:Eu^{2+}$) may be used as the fluorescent material.

The heat sink 120 is made of elongated rectilinear aluminum, for example, and is disposed on a back surface 117 (an opposite side surface to the mounting surface 112) of the substrate 111 in alignment with the substrate 111 in the lengthwise direction and fixed to the substrate 111 by adhesion, screwing, or the like, for example. The heat sink 120 and the LED module 11 are in thermal contact with each other so that the heat generated from the LEDs 110 is transmitted to the heat sink 120 via the substrate 111 and discharged from the heat sink 120 by radiation. By providing the heat sink 120 and the substrate 111 in surface contact, a superior heat discharge effect can be obtained.

Note that the heat sink 120 is not limited to aluminum, but the material thereof preferably has low weight and excellent thermal conductivity. Further, the heat sink 120 may be formed in any shape, but is preferably shaped so as not to block the light emitted from the LED module 11.

Figure 3:
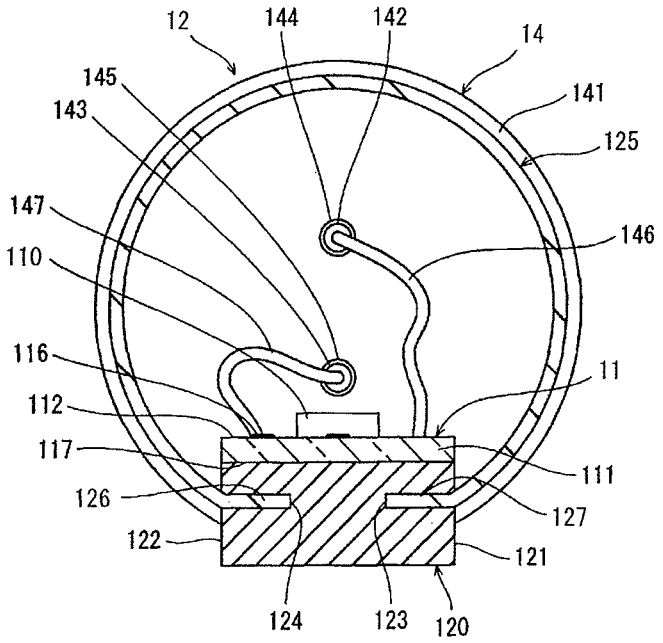
FIG. 3 is a sectional view taken along a B-B line in FIG. 1.
Figure 4:
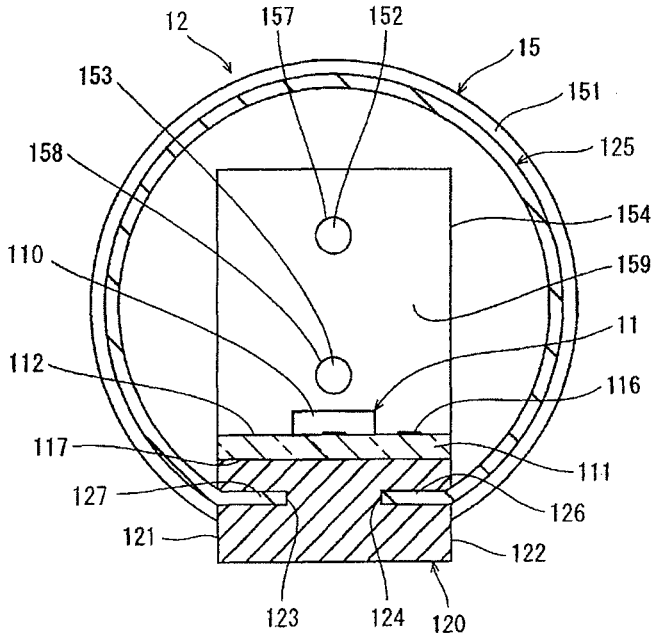
FIG. 4 is a sectional view taken along a C-C line in FIG. 1.

As shown in FIGS. 3 and 4, the cover 125 takes an elongated shape having a substantially arc-shaped cross-section, for example, and is disposed in alignment with the heat sink 120 in the lengthwise direction. The cover 125 is attached to the heat sink 120 while covering the LED module 11 by fitting a pair of side end portions (widthwise direction end portions) 126, 127 into grooves 123, 124 provided respectively in side faces 121, 122 of the heat sink 120.

The cover 125 is formed from a translucent material such as glass or a resin such as polycarbonate, for example. Note that glass exhibits high thermal conductivity (approximately five times that of polycarbonate) and a superior heat discharge effect for suppressing a temperature increase in the LEDs, and is therefore suitable as the material of the cover 125.

Returning to FIG. 2, the first cap 14 includes a cap-shaped main body 141 and a pair of cap pins 142, 143, and is disposed on one lengthwise direction end (a first end) side of the straight tube 12. The main body 141 is constituted by a heat-resistant synthetic resin such as silicon resin, for example. The pair of cap pins 142, 143 is made of a metal such as aluminum or copper, for example. The pair of cap pins 142, 143 is implanted in the main body 141 by press-fitting so as to penetrate respective through holes 144, 145 provided in the main body 141, and electrically connected to the wiring pattern 116 on the LED module 11 via lead wires 146, 147.

The second cap 15 includes a cap-shaped main body 151, a pair of cap pins 152, 153, and a conductive member 154, and is disposed on another lengthwise direction end (a second end) side of the straight tube 12. The main body 151 is made from a heat-resistant synthetic resin such as silicon resin, for example. The pair of cap pins 152, 153 is made of a metal such as aluminum or copper, for example. The pair of cap pins 152, 153 is implanted in the main body 151 by press-fitting so as to penetrate respective through holes 155, 156 provided in the main body 151.

The conductive member 154 is a substantially quadrilateral, plate-shaped, conductive member that is disposed on the heat sink 120 side of the main body 151 and fixed to the main body 151 by adhesion, screwing, or the like, for example. The conductive member 154 is provided with through holes 157, 158 in positions corresponding respectively to the through holes 155, 156 in the main body 151. The pair of cap pins 152, 153 is inserted into the through holes 157, 158 in the conductive member 154 and electrically connected to the conductive member 154 by soldering, welding, adhesion using a conductive adhesive, or the like, for example.

A heat sink 120 side surface 159 of the conductive member 154 is in surface contact with the heat sink 120, and through this contact, the conductive member 154 is electrically connected to the heat sink 120. Note that the electrical connection between the conductive member 154 and the heat sink 120 is not limited to simple contact, and may be formed by a mechanical as well as an electrical connection through soldering, welding, adhesion using a conductive adhesive, or the like, for example.

Note that the conductive member 154 is not a requirement of the present invention, and as long as the heat sink 120 and the cap pins 152, 153 are electrically connected, the conductive member 154 may be omitted. Accordingly, the cap pins 152, 153 and the heat sink 120 may be electrically connected to each other directly, for example.

Figure 5:
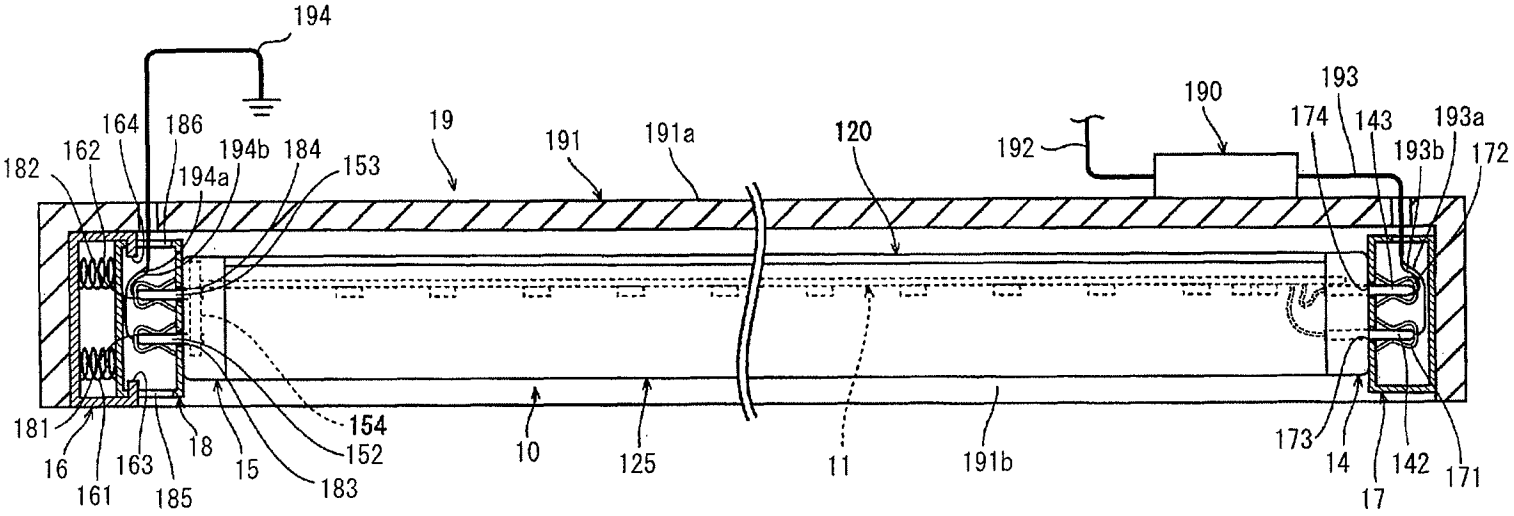
FIG. 5 is a view illustrating attachment of the straight tube LED lamp to a lighting fixture.

FIG. 5 is a view illustrating attachment of the straight tube LED lamp to a lighting fixture. As shown in FIG. 5, a lighting fixture 19 includes a casing 191, a first lamp socket 17, a second lamp socket 18, and a lighting circuit 190. The first and second lamp sockets 17, 18, to which the straight tube LED lamp 10 is attached, are included in the lighting fixture 19 as a lamp socket set (system).

The casing 191 is a substantially box-shaped member having an open lower surface, for example, wherein an upper surface 191*a* thereof serves as an attachment surface that is attached to a ceiling or the like, an inner surface 191*b* thereof serves as a light reflecting surface, and the lamp 10 is housed in an interior thereof. Further, the lighting circuit 190 is attached to the upper surface 191*a* of the casing 191, while the first lamp socket 17 and the second lamp socket 18 are attached to the interior of the casing 191 so as to face each other.

Plate spring-shaped power feeding contacts 171, 172 that are electrically connected to the respective cap pins 142, 143 are built into the first lamp socket 17. In the example of FIG. 5, the power feeding contacts 171, 172 each have a U-shaped cross-section in which a central portion of each side portion is bent inward. When the cap pins 142, 143 are inserted into pin holes 173, 174 provided in the first lamp socket 17, the cap pins 142, 143 are electrically connected to the respective power feeding contacts 171, 172. In other words, a first terminal (i.e. the cap pins 142, 143) for forming an electrical connection to a power feeding terminal (i.e. the power feeding contacts 171, 172) of the first lamp socket 17 is provided in the first cap 14.

The lighting circuit 190 serves as a direct current power supply that lights the LEDs 110 by converting an alternating current voltage from a commercial alternating current power supply into a direct current voltage and supplying the direct current voltage to the first cap 14 of the lamp 10 via the first lamp socket 17. The lighting circuit 190 and the commercial alternating current power supply are connected via a power supply line 192, while the lighting circuit 190 and the pair of power feeding contacts 171, 172 of the first lamp socket 17 are connected via a power supply line 193. The power supply line 193 bifurcates into two wires 193*a*, 193*b* on the side of the power feeding contacts 171, 172, and the two wires 193*a*, 193*b* are electrically connected to the respective power feeding contacts 171, 172.

Figure 6:
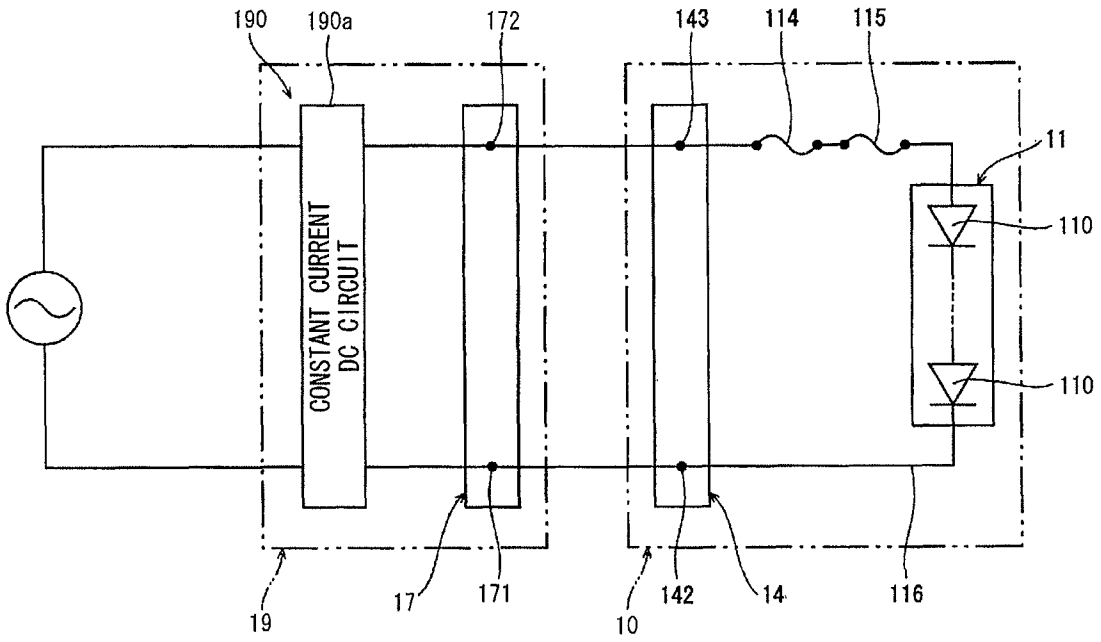
FIG. 6 is a circuit diagram of the straight tube LED lamp and the lighting fixture.

FIG. 6 is a circuit diagram of the straight tube LED lamp and the lighting fixture. Note that in the drawing, the number of LEDs 110 is reduced. As shown in FIG. 6, the lighting circuit 190 includes a constant current direct current circuit 190*a*, for example. The constant current direct current circuit 190*a* may be constructed using a rectifier diode, a smoothing capacitor, and so on, for example.

Returning to FIG. 5, plate spring-shaped grounding contacts 181, 182 that are electrically connected to the respective cap pins 152, 153 are built into the second lamp socket 18. In the example of the drawing, the grounding contacts 181, 182 each have a U-shaped cross-section in which a central portion of each side portion is bent inward. When the cap pins 152, 153 are inserted into terminal holes 183, 184 provided in the second lamp socket 18, the cap pins 152, 153 are electrically connected to the respective grounding contacts 181, 182. In other words, a second terminal (the cap pins 152, 153) for forming an electrical connection to a grounding terminal (i.e. the grounding contacts 181, 182) of the second lamp socket 18 is provided in the second cap 15.

The grounding contacts 181, 182 are grounded via an earth wire 194. The earth wire 194 bifurcates into two conductive wires 194*a*, 194*b* on the side of the grounding contacts 181, 182, and the two conductive wires 194*a*, 194*b* are electrically connected to the respective grounding contacts 181, 182.

The second lamp socket 18 is held by a socket holding member 16 attached to the inner surface 191*b* of the casing 191. The socket holding member 16 includes biasing bodies (springs, for example) 161, 162 that bias the second lamp socket 18 to the first lamp socket 17 side, and pawl portions 163, 164 that are fitted into slit grooves 185, 186 in the second lamp socket 18 in order to restrict movement of the second lamp socket 18 in the lamp lengthwise direction to a fixed range. Thus, the second lamp socket 18 is capable of sliding relative to the socket holding member 16.

To attach the lamp 10 to the lighting fixture 19, first, the second lamp socket 18 is moved in a direction heading away from the first lamp socket 17 using the second cap 15 while inserting the cap pins 152, 153 of the second cap 15 into the terminal holes 183, 184 in the second lamp socket 18. As a result, a distance between the second lamp socket 18 and the first lamp socket 17 increases. Next, the lamp 10 is moved to the first lamp socket 17 side in order to insert the cap pins 142, 143 of the first cap 14 into the pin holes 173, 174 in the first lamp socket 17 so that the first cap 14 is attached to the first lamp socket 17. The second lamp socket 18 is biased to the first lamp socket 17 side by the biasing bodies 161, 162, and therefore the lamp 10 is held by the second lamp socket 18 and the first lamp socket 17.

When the lamp 10 is attached, the cap pins 142, 143 are electrically connected to the respective power feeding contacts 171, 172, and therefore a direct current voltage is input into the first cap 14 from the lighting fixture 19. Further, the heat sink 120 is grounded via the conductive member 154, the cap pins 152, 153, the grounding contacts 181, 182, and the earth wire 194.

The heat sink 120 is made of aluminum and is therefore conductive. Hence, a current may flow to the heat sink 120 due to electric leakage or the like from the LED module 11 and the lighting circuit 190. When the lamp 10 is attached to the lighting fixture 19, however, the heat sink 120 is grounded and does not therefore have a potential. As a result, an electric shock is not received even when the heat sink 120 is touched.

Note that even when the cover 125 is constituted by a conductive material, the cover 125 is attached to the heat sink 120 and therefore grounded. Hence, there is no risk of an electric shock even when the cover 125 is touched.

In this embodiment, the straight tube is formed of the heat sink serving as a conductive member, and the cover. However, the straight tube according to the present invention is not limited to this configuration. For example, the entire straight tube may be formed from a conductive member or the straight tube may be configured so as not to function as a heat sink. In the latter case, a conductor (a conductive member) such as a heat sink, a reflector, or a mechanism functioning as both a heat sink and a reflector is preferably placed in an insulating glass tube or resin tube. With this configuration, no problems occur during normal use even when the conductor is not electrically connected to the second terminal of the second cap. However, in consideration of a situation where the lamp breaks due to a fall or the like such that the conductor is exposed, the conductor is preferably grounded by being electrically connected to the second terminal of the second cap in order to prevent electric shocks.

In the embodiment described above, the second cap includes a plurality of cap pins, for example two cap pins. However, the second cap preferably includes a single cap pin as the second terminal. Further, the grounding terminal of the second lamp socket is not limited to a plurality of grounding contacts (two grounding contacts, for example). The second lamp socket preferably includes a single grounding contact as the grounding terminal.

In the embodiment described above, the LED module is formed of a single substrate but is not limited thereto. The LED module may be constructed by electrically connecting and coupling two or more substrates. Further, in the above embodiment, the plurality of LEDs is provided in a single row on the substrate, but is not limited to this arrangement.

The LEDs may be provided in two or more rows. Moreover, the number of LEDs forming the LED module is arbitrary. Furthermore, in the above embodiment, all of the LEDs are connected in series, but the LEDs are not limited to this arrangement. Instead, a so-called series parallel connection may be realized by connecting groups of a predetermined number of LEDs that are connected in series to each other in parallel or connecting groups of a predetermined number of LEDs that are connected in parallel to each other in series.

An inner peripheral surface or an outer peripheral surface of the cover may be coated with a light scattering agent. For example, the inner peripheral surface may be coated with aluminum powder as a light scattering agent. In so doing, the light from the LEDs is scattered so as to be emitted from the cover evenly, and a heat radiation performance is improved by a thermal conduction effect generated by the aluminum powder.

(Second Embodiment)

When the straight tube LED lamp described above has identical dimensions and identical caps to a straight tube fluorescent lamp, the straight tube LED lamp may be mistakenly connected to a lighting fixture having a lighting circuit for a straight tube fluorescent lamp.

Figure 7A:
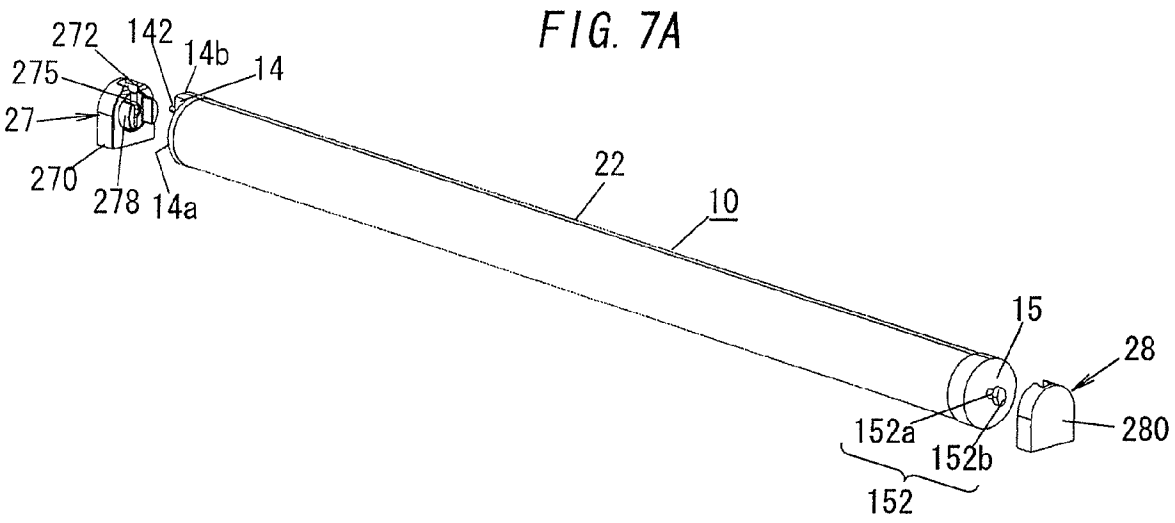
FIGS. 7A and 7B are external perspective views showing a straight tube LED lamp and a lamp socket set used therein according to a second embodiment.
Figure 7B:
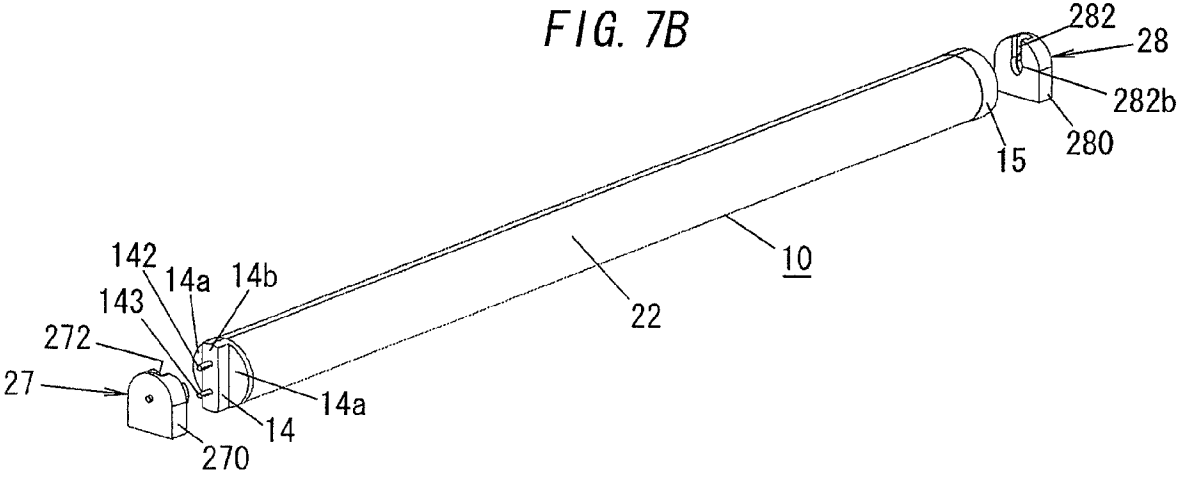

FIGS. 7A and 7B are external perspective views showing a straight tube LED lamp 10 for solving this problem. For the purpose of clarity, like kind elements are assigned the same reference numerals as depicted in the first embodiment.

The lamp 10 includes a single straight tube 22 that is formed from a translucent synthetic resin material, but not limited thereto. The single straight tube 22 may be a glass tube. A first cap 14 for power feeding is provided on one axial direction end side of the straight tube 22, and a second cap 15 for grounding is provided on another axial direction end side of the straight tube 22.

A substrate (see FIG. 1, for example) formed from a printed board having a slightly shorter overall length than the straight tube 22 is housed in the interior of the straight tube 22, and a plurality of LEDs is mounted at predetermined intervals on a mounting surface of the substrate. The substrate is attached to a conductor (a conductive member) such as a heat sink, a reflector, or a mechanism functioning as both a heat sink and a reflector, and placed in the straight tube 22. The conductor may be, but need not be, electrically connected to the second terminal of the second cap 15.

Figure 8A:
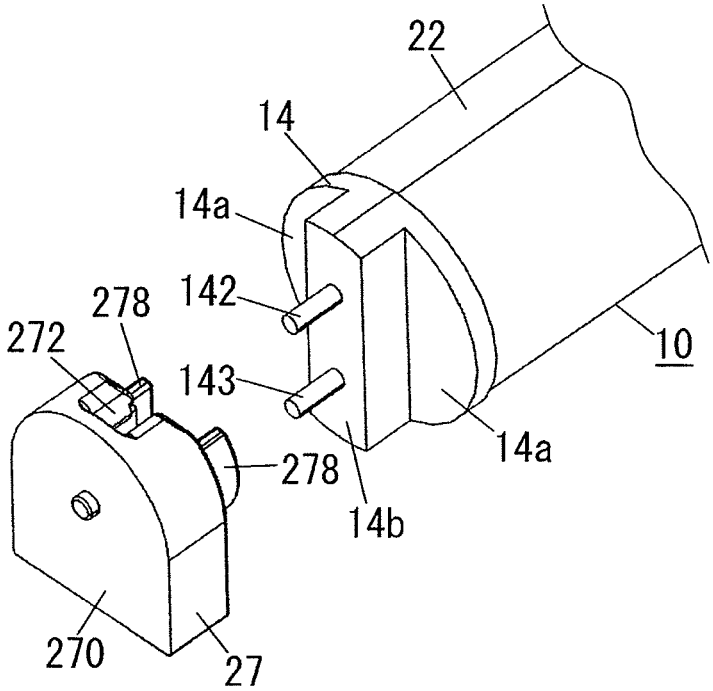
FIG. 8A is an enlarged external perspective view of a first cap and a first lamp socket for power feeding.

FIG. 8A is an enlarged perspective view showing main parts of the first cap 14. Recessed portions 14*a*, 14*a* recessed in a substantially semicircular shape. are provided on both sides of a central portion in a diameter direction in an end surface of the first cap 14. The central portion is provided with a projecting portion 14*b* that has a substantially rectangular parallelepiped shape and projects frontward from the recessed portions 14*a*. Two cap pins 142, 143 formed in a round bar shape from a metallic material are provided on the projecting portion 14*b* in symmetrical positions on either side of a central axis of the straight tube 22 so as to project in the axial direction. The two cap pins 142, 143 are electrically connected to the substrate in the interior of the straight tube 22 via lead wires, for example. Note that on a circuit formed on the substrate, the direct current voltage input from the cap pins 142, 143 is supplied to the LEDs via a full wave rectifier, and therefore a forward current flows through the LEDs even when either side of the cap pins 142, 143 is connected to a positive electrode side of the direct current power supply. Further, in the first embodiment, as shown in FIG. 3, the cap pins 142, 143 are arranged in an orthogonal direction to the mounting surface 112 of the substrate 111, whereas in the second embodiment, the cap pins 142, 143 are arranged in a parallel direction to the mounting surface of the substrate.

Figure 8B:
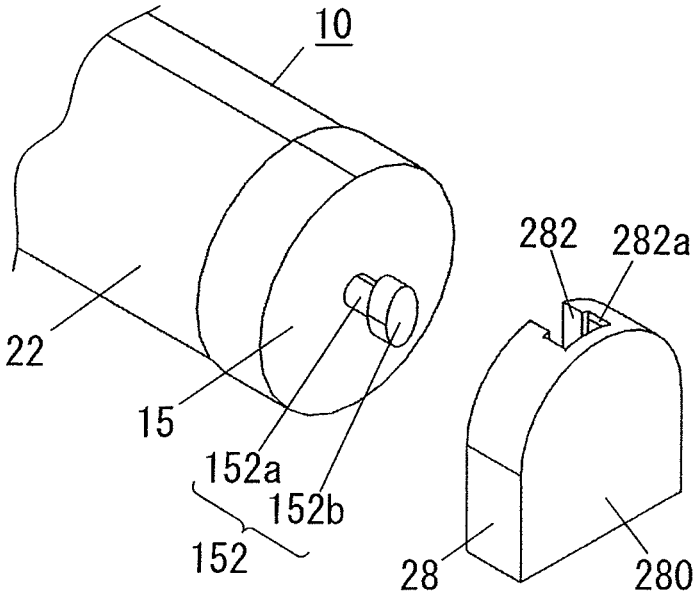
FIG. 8B is an enlarged external perspective view of a second cap and a second lamp socket for grounding.

FIG. 8B is an enlarged perspective view showing main parts of a second cap 15. An end surface of the second cap 15 is substantially disc-shaped, and a single cap pin 152 as the second terminal projects from a central portion of the end surface. The second terminal is formed of a shaft portion 152*a* and a latch portion (a cam plate) 152*b*. The shaft portion 152*a* is formed in a round bar shape from a metallic material, and projects in the axial direction. The latch portion 152*b* is made of metal, formed in an elliptical shape in which an attachment direction to first and second lamp sockets 27 and 28 constitutes a long diameter direction when the latch portion 152*b* is seen from the axial direction, and provided integrally with the shaft portion 152*a*. Note that the long diameter direction of the latch portion 152*b* is parallel to an arrangement direction of the two cap pins 142, 143.

A lamp socket set to which the lamp 10 is attached includes the first lamp socket 27 for power feeding, which includes a first cap reception portion to which the first cap 14 is attached, and the second lamp socket 28 for grounding, which includes a second cap reception portion to which the second cap 15 is attached.

Figure 10B:
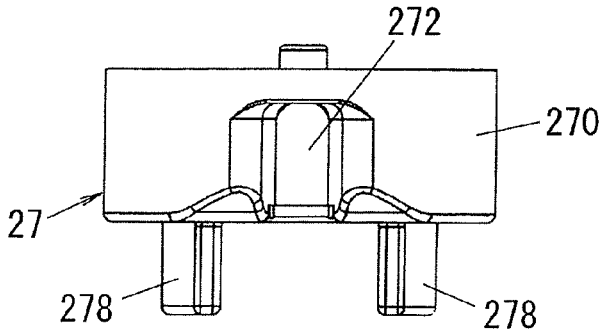
FIG. 10B is a top view.
Figure 10A:
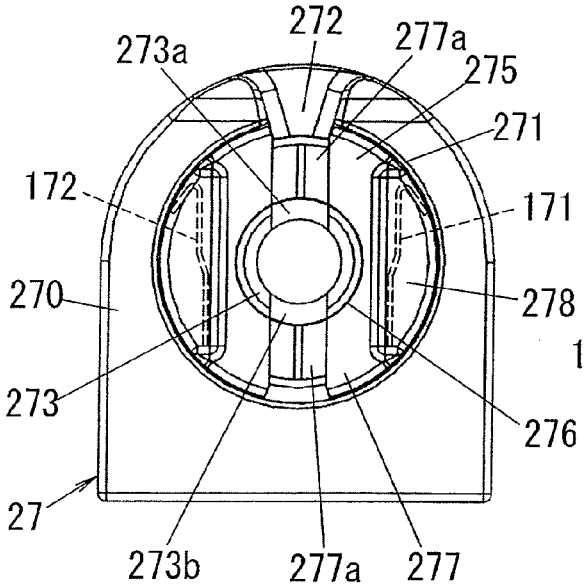
FIG. 10A is a front view.
Figure 10C:
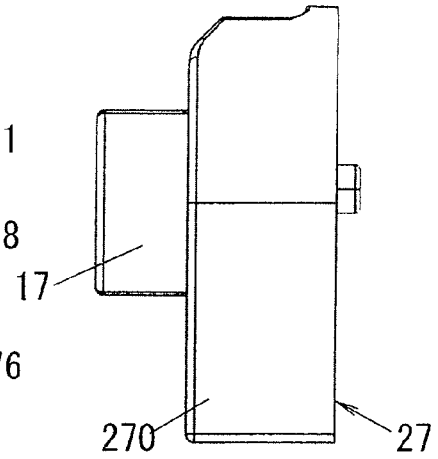
FIG. 10C is a right side view.
Figure 11:
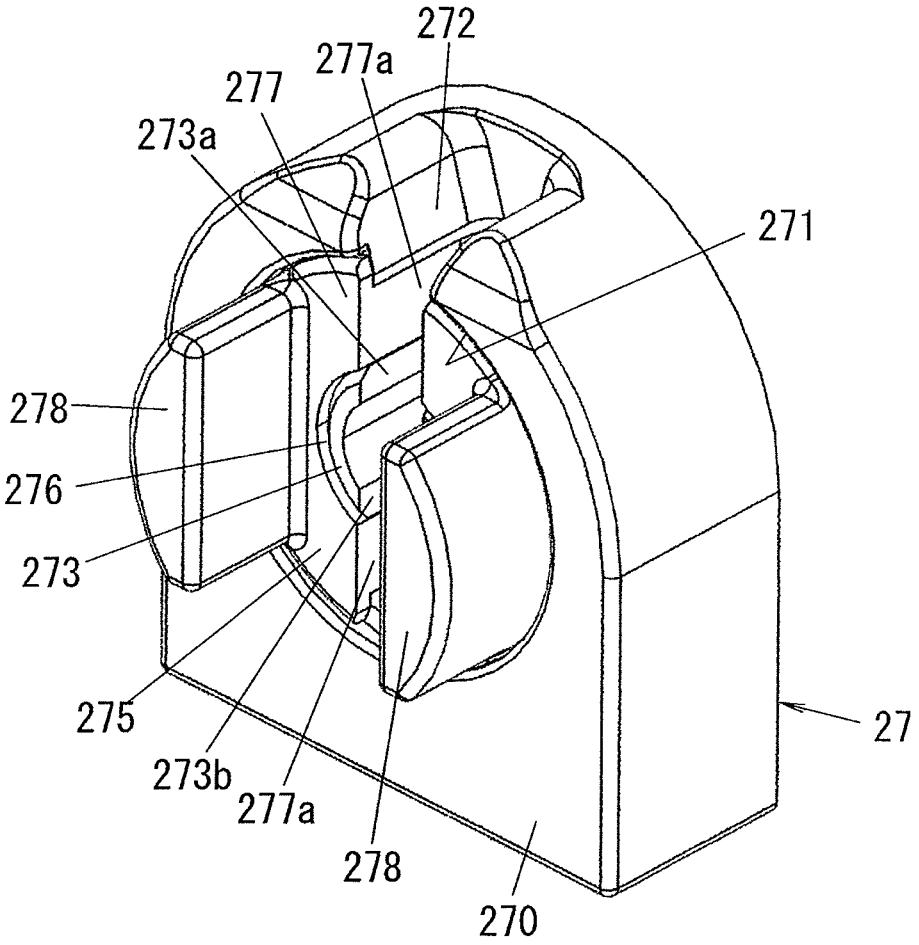
FIG. 11 is an enlarged external perspective view of the power feeding first lamp socket used in the second embodiment.

As shown in FIGS. 10 and 11, the first lamp socket 27 includes a body 270, a rotor 275 attached to the body 270 to be free to rotate, and a pair of power feeding contacts 171, 172 (see FIG. 10A) housed in the body 270.

The body 270 is molded into a substantially rectangular parallelepiped shape from synthetic resin, and includes a first surface (an outer surface in an attached condition), a second surface (an inner surface in the attached condition), and four side faces between the first and second surfaces. A recessed portion 271 recessed in the form of a circular hole is opened in the second surface (a front surface in FIG. 10A) of the body 270. One of the aforesaid side faces (a lower side face in the attached condition) is formed as a curved surface having a central portion that projects relative to respective edge portions thereof contacting the respective side faces, and includes an insertion groove 272 for the first terminal of the first cap 14. The insertion groove 272 is provided in the central portion of the lower side face (a side face on an upper side of FIG. 8A) of the body 270 and opens onto the second surface side so as to be connected to the recessed portion 271. Further, a cylindrical support shaft 273 that projects from a bottom portion (i.e. the first surface side) of the recessed portion 271 toward the second surface side is provided on the body 270. Grooves 273*a*, 273*b* aligned in a single row with the insertion groove 272 are formed in the support shaft 273.

The rotor 275 is constituted by a synthetic resin molded component and includes a substantially cylindrical tube portion 277 that has an axial hole 276 into which the support shaft 273 is fitted and is disposed to be free to rotate about the support shaft 273 when the support shaft 273 is fitted into the axial hole 276. An end surface of the tube portion 277 is in a substantially identical position to the second surface of the body 270. The tube portion 277 is formed with insertion grooves 277*a*, 277*a* that are aligned in a single row with the insertion groove 272 and the grooves 273*a*, 273*b* to form a single continuous groove that opens onto the second surface side when the tube portion 277 is rotated to a specific position (a position shown in FIG. 10A). Further, ribs (projecting portions) 278, 278 sandwiching the insertion grooves 277*a*, 277*a* are provided on the end surface of the tube portion 277 so as to project from the second surface side of the body 270. Respective inside surfaces (mutually opposing surfaces) of the ribs 278 are formed as flat surfaces, while respective outside surfaces are formed as circumferential surfaces centering on a rotary center of the tube portion 277. Note that an interval between the two ribs 278 is set at a slightly larger dimension than a width of the projecting portion 14*b* of the first cap 14. Further, a height dimension of the rib 278 (a distance from the end surface of the rotor 275 to a tip end of the rib 278) is smaller than a height dimension of the projecting portion 14*b* (a distance from a front surface of the recessed portion 14*a* to a tip end surface of the projecting portion 14*b*).

Here, when the rotor 275 is rotated to the specific position (an open position) shown in FIG. 10A, the insertion groove 272, the grooves 273*a*, 273*b*, and the insertion grooves 277*a*, 277*a* are aligned in a single row such that the cap pins 142, 143 can be inserted into the insertion grooves 277*a*, 277*a* of the rotor 275 through the insertion groove 272 and moved to the outside. When the rotor 275 is rotated 90 degrees from the position shown in FIG. 10A, on the other hand, the insertion grooves 277*a*, 277*a* are arranged in an orthogonal direction to the direction in which the insertion groove 272 and the grooves 273*a*, 273*b* are aligned in a single row. In this case, respective end sides of the insertion grooves 277*a*, 277*a* are blocked by a peripheral edge portion of the recessed portion 271 and an outer peripheral surface of the support shaft 273, and therefore the cap pins 142, 143 are held in the insertion grooves 277*a*, 277*a*. Further, the held cap pins 142, 143 are electrically connected to the respective power feeding contacts 171, 172 (or 172, 171). Here, the rotor 275 and the power feeding contacts together constitute the first cap reception portion to which the first cap 14 is attached.

Figure 12B:
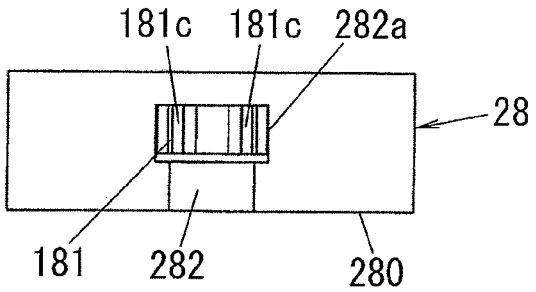
FIG. 12B is a top view.
Figure 12A:
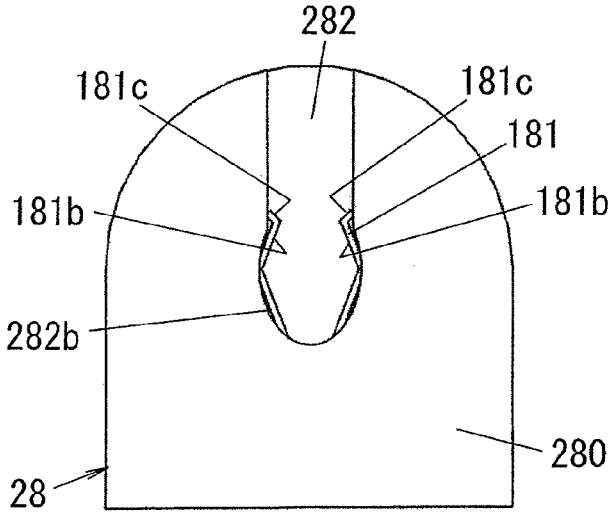
FIG. 12A is a front view.
Figure 12C:
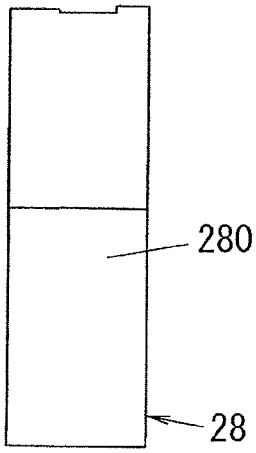
FIG. 12C is a right side view.
Figure 13:
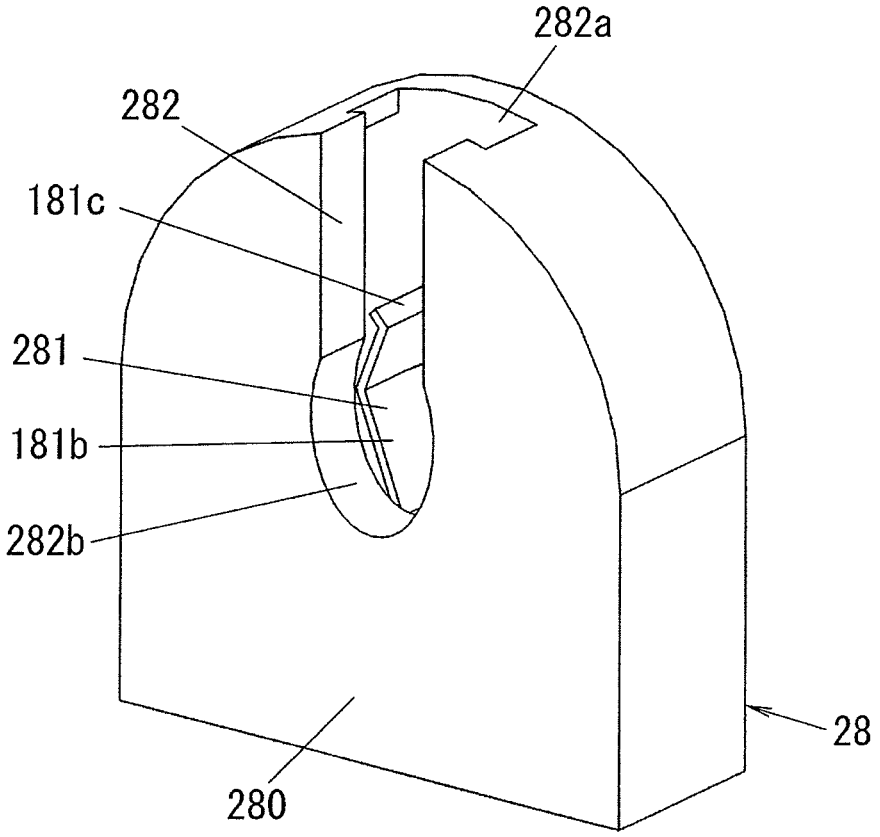
FIG. 13 is an external perspective view of the grounding second lamp socket used in the second embodiment.

Next, the second lamp socket 28 will be described with reference to FIGS. 12 and 13. The second lamp socket 28 includes a body 280 and a grounding contact 181 housed in the body 280.

The body 280 is molded into a substantially rectangular parallelepiped shape from synthetic resin, and includes a first surface (an outer surface in an attached condition), a second surface (an inner surface in the attached condition), and four side faces between the first and second surfaces. One of the side faces (a lower side face in the attached condition) is formed as a curved surface having a central portion that projects relative to respective edge portions thereof contacting the respective side faces, and includes an insertion groove 282 for the second terminal of the second cap 15. The insertion groove 282 is formed to extend from the lower side face (an upper side face in FIG. 13) of the body 280 to the second surface, and the second terminal (the cap pin 152) of the lamp 10 is inserted therein. A wide portion 282*a* is provided on a rear side of the insertion groove 282 in the lower side face (the side face on the upper side of FIG. 13) of the body 280, and has a groove width greater than that at a side close to the second cap 15. The latch portion 152*b* of the second terminal is inserted into the wide portion 282*a*. The groove width of the wide portion 282*a* is greater than a short diameter dimension of the latch portion 152*b* of the second terminal. Further, the groove width of a narrow part of the insertion groove 282 in the lower side face of the body 280 is set to be greater than a diameter of the shaft portion 152*a* and smaller than the short diameter dimension of the latch portion 152*b*. The insertion groove 282 in the lower side face is formed to extend to a center of the second surface of the body 280 up to a position in which the second terminal is inserted when the lamp 10 is attached. An elliptical opening portion 282*b* that is slightly larger than the latch portion 152*b* of the second terminal is formed in an end portion of the insertion groove 282 in the center of the second surface.

Figure 14:
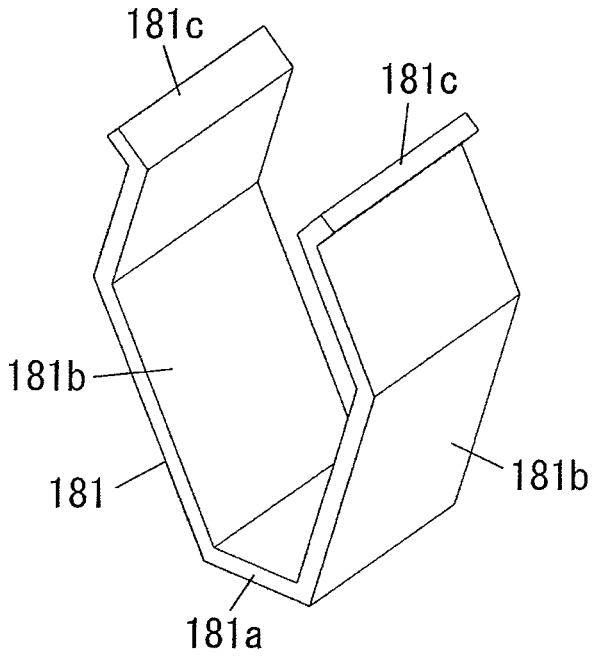
FIG. 14 is an external perspective view of a grounding contact of the grounding second lamp socket used in the second embodiment.

As shown in FIG. 14, the grounding contact 181 is formed by bending a strip of a metallic material (a copper alloy, for example) exhibiting favorable conductivity. In the example in the drawing, the grounding contact 181 has a U-shaped cross-section in which a central portion of each side portion is bent outward. More specifically, the grounding contact 181 is formed integrally from a center piece 181*a* fixed to the body 280, contact pieces 181*b*, 181*b* that project upward from respective side edges of the center piece 181*a*, and guide pieces 181*c*, 181*c* bent outward from respective tip end portions of the contact pieces 181*b*, 181*b*. Here, each contact piece 181*b* is bent substantially into a V shape such that an intermediate portion of each contact piece 181*b* projects in an outward direction. Thus, the grounding terminal 181 is formed as a whole in an inverted Ω shape.

The grounding contact 181 is housed in the body 280 such that an internal space of the insertion groove 282 is interposed between the contact pieces 181*b*, 181*b*, the guide pieces 181*c* are provided on the wide portion 282*a* side, and the center piece 181*a* is provided on the side of the upper side face facing the lower side face. Here, a site in which the insertion groove 282 of the body 280 is provided and the grounding contact 181 together constitute the second cap reception portion to which the second cap 15 is attached.

Figure 9:
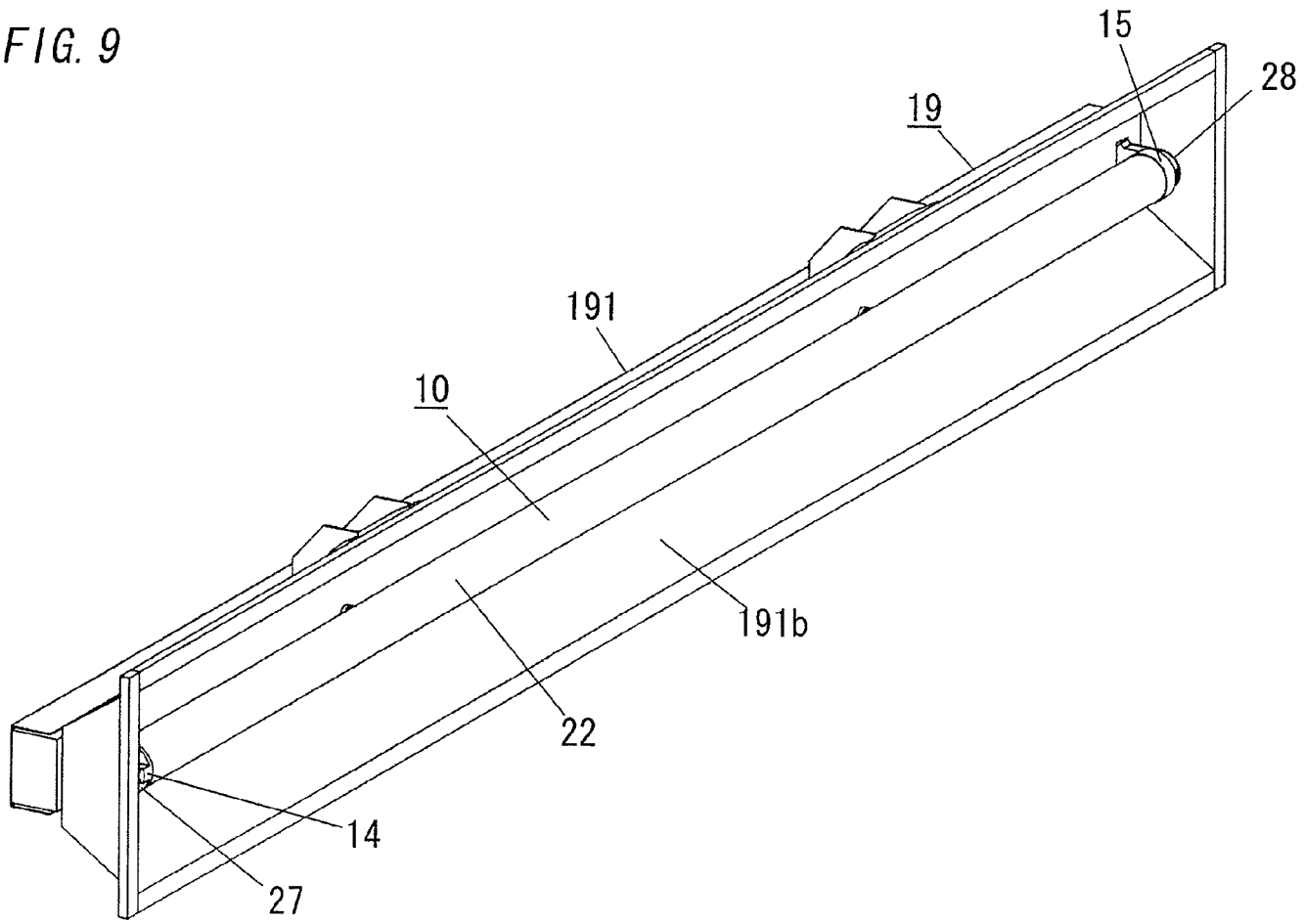
FIG. 9 is an external perspective view of a lighting fixture using the straight tube LED lamp and lamp socket set according to the second embodiment.

FIG. 9 is an external perspective view of a lighting fixture 19 including the first and second lamp sockets 27, 28 described above. The lighting fixture 19 is used while embedded in a ceiling surface. A lighting circuit (see FIG. 6) is housed in an interior of an elongated rectangular parallelepiped-shaped casing 191. The first and second lamp sockets 27, 28 are attached to lower side faces of respective lengthwise direction end portions of the casing 191 so as to face each other. The lamp 10 is attached to the casing 191 by attaching the first cap 14 and the second cap 15 provided on the respective ends of the lamp 10 to the first lamp socket 27 and the second lamp socket 28, respectively. Note that 191*b* in FIG. 9 denotes a reflector for reflecting the light emitted from the LED lamp 10 to a lower side illumination space.

A method for attaching and detaching the LED lamp 10 to and from the first and second lamp sockets 27, 28 will now be described.

To attach the lamp 10 to the first and second lamp sockets 27, 28, the lamp 10 is brought close to the first and second lamp sockets 27, 28 from below the casing 191 with the first cap 14 on the first lamp socket 27 side and the second cap 15 on the second lamp socket 28 side. Then, when the cap pins 142, 143 are inserted into the insertion groove 272 of the first lamp socket 27 and the second terminal (the cap pin 152) is inserted into the insertion groove 282 of the second lamp socket 28, the projecting portion 14*b* of the first cap 14 is inserted between the pair of ribs 278, 278. When the LED lamp 10 is inserted up to a prescribed insertion position, the two cap pins 142, 143 are inserted into the respective insertion grooves 277*a*, 277*a* and the second terminal is inserted between the contact pieces 181*b*, 181*b* of the grounding contact 181. When, in this condition, the straight tube 22 is rotated 90 degrees such that the LEDs are oriented downward, the projecting portion 14*b* presses the ribs 278, 278 such that the rotor 275 rotates together with the straight tube 22, and as a result, the cap pins 142, 143 are disposed on both sides of the support shaft 273. At this time, the two cap pins 142, 143 are electrically connected to the two power feeding contacts disposed in the body 270 such that direct current power is supplied from the lighting circuit (the direct current power supply) to the LEDs via the first lamp socket 27. Further, as the straight tube 22 rotates, the latch portion 152*a* rotates to a position in which the long diameter direction thereof is parallel with a horizontal direction, and as a result, respective long diameter direction side portions of the latch portion 152*b* contact the contact pieces 181*b*, 181*b*. At this time, the latch portion 152*b* is electrically connected to the grounding contact 181, and therefore the lamp 10 is grounded. Further, the width dimension of the latch portion 152*b* in the horizontal direction is greater than the width dimension when the long diameter direction of the latch portion 152*b* is parallel with a lamp insertion direction, and therefore the left and right contact pieces 181*b* are bent outward by the respective long diameter direction side portions of the latch portion 152*b*. As a result, the latch portion 152*b* is held mechanically by an elastic force of the left and right contact pieces 181*b*. Furthermore, in this condition, the cap pins 142, 143 are held in the respective insertion grooves 277*a*, 277*a*, and therefore the first cap 14 does not become detached from the first lamp socket 27.

Meanwhile, to detach the lamp 10 from the first and second lamp sockets 27, 28, when the straight tube 22 is rotated 90 degrees from the attached condition, the insertion groove 272, the grooves 273*a*, 273*b*, and the insertion grooves 277*a*, 277*a* are aligned in a single row. In this case, the cap pins 142, 143 can be moved to the outside of the insertion grooves 277*a*, 277*a*, and therefore, by moving the first cap 14 side of the lamp 10 downward, the cap pins 142, 143 exit the insertion groove 272 to the outside. When the straight tube 22 is pulled in a direction separating from the second lamp socket 28 in a condition where the first cap 14 is detached from the first lamp socket 27 and the straight tube 22 is tilted diagonally with the first cap 14 on a lower side, the second terminal exits the opening portion 282*b* to the outside, whereby detachment of the LED lamp 10 is complete. Here, the opening portion 282*b* provided in the end portion of the insertion groove 282 is larger than the second terminal (the latch portion 152*b*), and therefore the second terminal (the latch portion 152*b*) can pass through the opening portion 282*b*. Hence, when detaching the lamp 10, the second terminal can be withdrawn to the outside directly from the opening portion 282*b*, thereby eliminating the need to withdraw the second terminal to the outside through an opening in the lower side of the insertion groove 282 by moving the second terminal downward within the insertion groove 282. As a result, the lamp 10 can be detached easily.

Note that when an attempt is made to attach a cap of a straight tube fluorescent lamp to the first lamp socket 27 for the straight tube LED lamp, the ribs 278, 278 interfere with an end surface of the cap of the straight tube fluorescent lamp, and therefore a straight tube fluorescent lamp is not attached by mistake.

As described above, in the lamp 10 according to this embodiment, the first cap 14 is provided on one axial direction end side of the straight tube 22 and the second cap 15 is provided on the other axial direction end side. The first terminal (the cap pins 142, 143) that is electrically connected to the power feeding contact of the first lamp socket 27 is provided in the first cap 14, and the second terminal (the cap pin 152 having the latch portion 152*b*) that is electrically connected to the grounding contact 181 of the second lamp socket 28 is provided in the second cap 15.

Thus, different caps are provided on the respective end sides of the straight tube 22, and therefore the possibility of mistakenly connecting the straight tube LED lamp 10 according to this embodiment to a lighting fixture for a straight tube fluorescent lamp having identically shaped caps on both ends can be reduced. Further, the straight tube LED lamp 10 according to this embodiment is easily distinguishable from a straight tube fluorescent lamp having identically shaped caps on both ends, and therefore the possibility of mistakenly connecting the lamp 10 and a straight tube fluorescent lamp to incompatible lighting fixtures respectively can be further reduced.

Furthermore, the latch portion 152*b* provided on the second terminal is formed to be elongated in the attachment direction to the second lamp socket 28 when seen from the axial direction.

Hence, when the latch portion 152*b* is inserted into the insertion groove 282 in the second lamp socket 28, the latch portion 152*b* has a smaller horizontal direction dimension than when the straight tube 22 is rotated 90 degrees, and therefore a force required to insert the latch portion 152*b* between the contact pieces 181*b*, 181*b* can be reduced. Further, when the straight tube 22 is rotated 90 degrees after inserting the latch portion 152*b*, the horizontal direction dimension of the latch portion 152*b* increases, enabling an increase in a bending amount of the contact pieces 181*b*, 181*b*, and as a result, a force by which the grounding contact 181 holds the second terminal can be increased.

Further, the lamp socket set to which the lamp 10 is attached is formed of the first lamp socket 27 including the first cap reception portion to which the first cap 14 is attached, and the second lamp socket 28 including the second cap reception portion to which the second cap 15 is attached.

Hence, the lamp socket set to which the lamp 10 is attached is formed of the first lamp socket 27 and the second lamp socket 28, and therefore the possibility of mistakenly attaching a straight tube fluorescent lamp having identically shaped caps on both ends to the lamp socket set can be reduced.

Furthermore, the end surface of the first cap 14 is provided, on both sides of the central portion in a diameter direction, with the recessed portions 14*a*, 14*a*, while the two cap pins 142, 143 (the first terminal) are provided on the projecting portion 14*b* provided in the central portion. The ribs 278, 278, meanwhile, are provided on the rotor 275 of the first lamp socket 27 in sites corresponding to the recessed portions 14*a*, 14*a* of the first cap 14.

Hence, when an attempt is made to attach a cap of a straight tube fluorescent lamp to the first lamp socket 27, the ribs 278, 278 interfere with the end surface of the cap of the straight tube fluorescent lamp, and therefore the straight tube fluorescent lamp is not attached by mistake.

Moreover, the first cap reception portion of the first lamp socket 27 includes the rotor 275 that includes the insertion grooves 277*a*, 277*a* into which the cap pins 142, 143 are inserted and rotates in accordance with rotation of the straight tube 22, and the power feeding contacts that are electrically connected to the cap pins 142, 143 when the rotor 275 is rotated.

Hence, by rotating the straight tube 22 after inserting the cap pins 142, 143 provided on the first cap 14 into the insertion grooves 277*a*, 277*a*, an electrical connection and a mechanical hold can both be realized.

Furthermore, the second cap reception portion of the second lamp socket 28 is provided with the grounding contact 181 that electrically connects and mechanically holds the second terminal.

As a result, the second terminal can be electrically connected and mechanically held by the single grounding terminal 181, and therefore a separate configuration for holding the second cap 15 is not required.

The second cap reception portion is also provided with the insertion groove 282 into which the second terminal is inserted and the grounding contact 181 that is disposed in the insertion groove 282 and electrically connected to the second terminal, and when the second terminal is in contact with the grounding contact 181, the second terminal is free to rotate.

Hence, there is no need to provide the second cap reception portion with a rotation mechanism even in a case where the first cap 14 is attached to the first lamp socket 27 by rotating the straight tube 22, and as a result, the configuration of the second cap reception portion can be simplified.

Furthermore, the wide portion 282*a* having a greater groove width than that at the side close to the second cap 15 in the axial direction of the straight tube 22 is provided in the insertion groove 282 on the first surface side of the body 280.

As a result, the lamp 10 can be retained by engaging the latch portion 152*b* of the second terminal with the part having a narrow groove width.

Moreover, the opening portion 282*b*, which is larger than the second terminal, is provided in a terminal end portion of the insertion groove 282.

Therefore, when the first cap 14 is detached from the first lamp socket 27, the second terminal can be detached through the opening portion 282*b*, i.e. without passing through the insertion groove 282, and as a result, the lamp 10 can be detached easily.

Figure 15A:
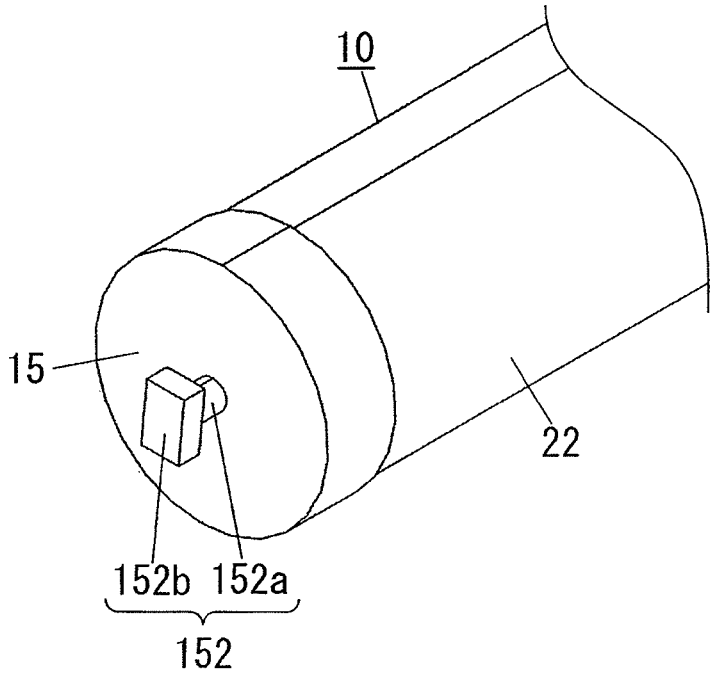
FIGS. 15A and 15B are enlarged perspective views showing main parts of a straight tube LED lamp according to an embodiment.
Figure 16B:
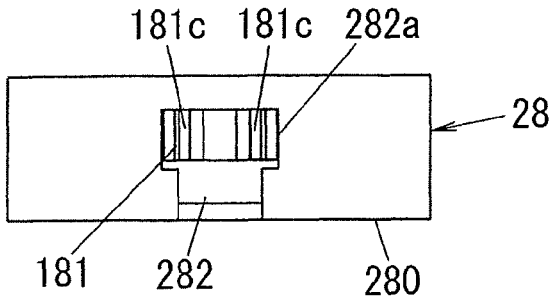
FIG. 16B is a top view.
Figure 16A:
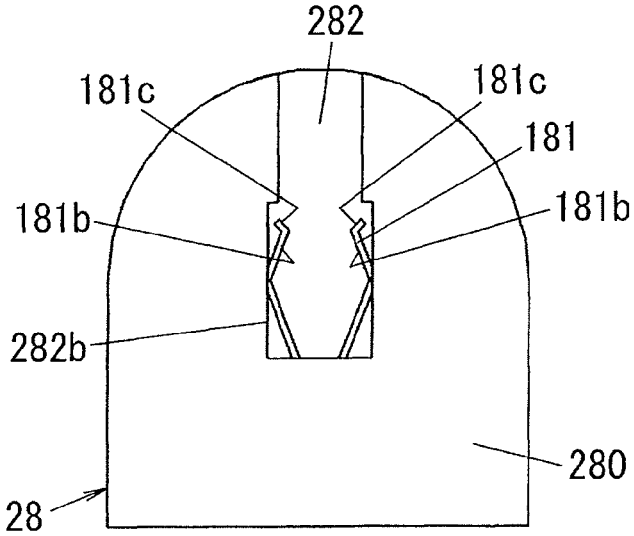
FIG. 16A is a front view.
Figure 16C:
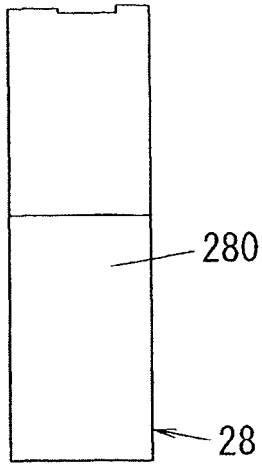
FIG. 16C is a right side view.
Figure 17:
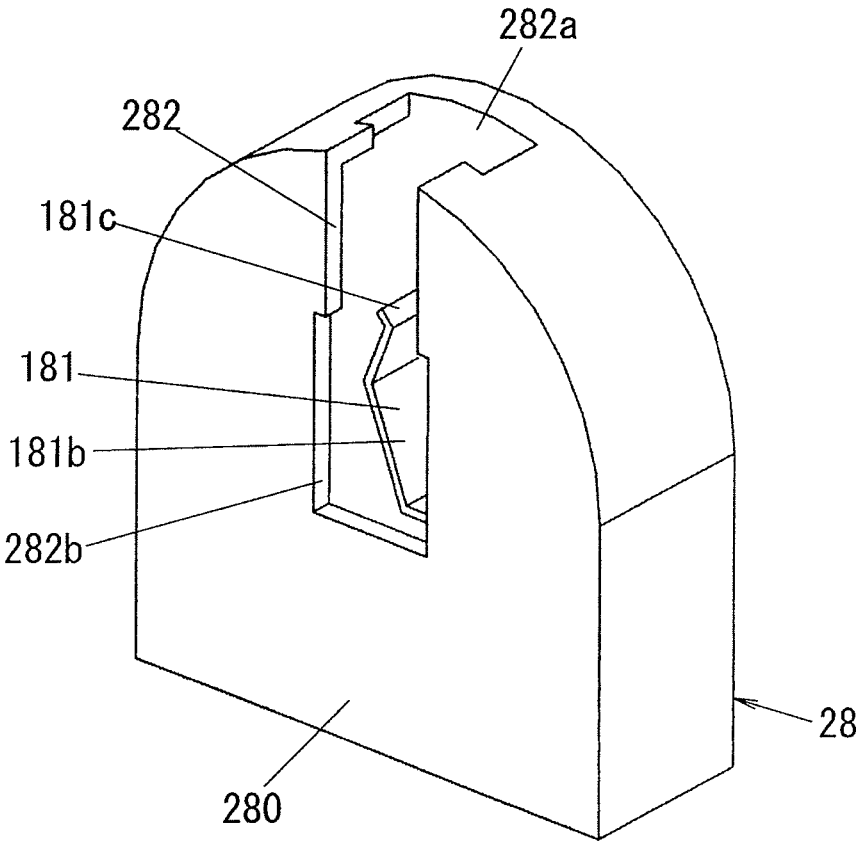
FIG. 17 is an external perspective view of the grounding second lamp socket used in the above embodiment.

In an embodiment, as shown in FIG. 15A, the latch portion 152*b* of the second terminal is formed in a rectangular shape when seen from the axial direction. FIGS. 16 and 17 show the second lamp socket 28 to which the second cap 15 having this second terminal is attached. The opening portion 282*b* of the second lamp socket 28 opens in a rectangular shape in the end portion of the insertion groove 282 in the second surface of the body 280. The opening portion 282*b* is formed to have a slightly larger dimension than the latch portion 152*b* of the second terminal, shown in FIG. 15A, so that the rectangular latch portion 152*b* can be withdrawn frontward through the opening portion 282*b*, as described in the first embodiment.

Figure 15B:
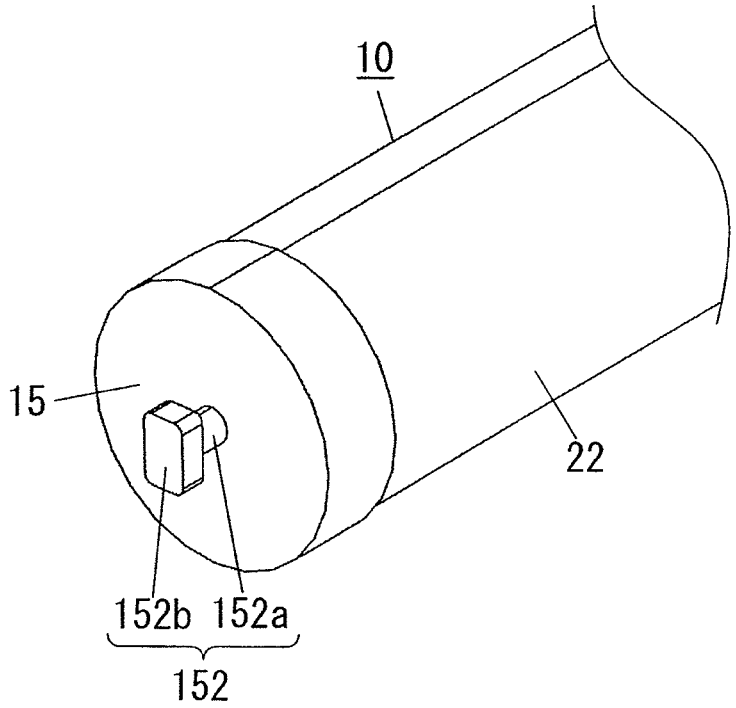

In an embodiment, as shown in FIG. 15B, the latch portion 152*b* is formed in a rectangular shape having rounded corners, and is smaller than the opening portion 282*b* shown in FIGS. 16 and 17.

Figure 18:
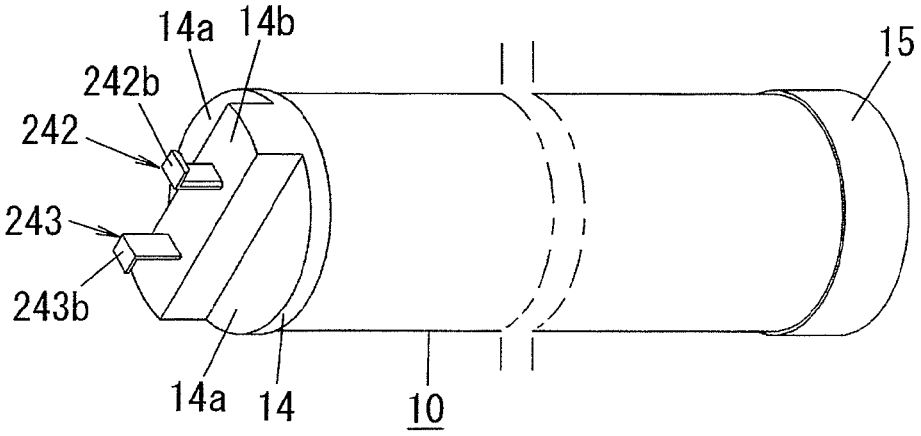
FIG. 18 is an external perspective view showing another embodiment of the straight tube LED lamp.

Incidentally, the first terminal of the first cap according to the present invention is not limited to the round bar-shaped cap pins 142, 143. The first terminal may be constituted by cap pins (blade plugs) 242, 243 shaped as shown in FIG. 18, for example. The cap pins 242, 243 shown in FIG. 18 are formed by bending strip-form sheet metal, and disposed such that respective base portion sides thereof are parallel to the lamp axis direction. Latch portions 242*b*, 243*b* are formed by bending tip end sides of the two cap pins 242, 243 substantially at right angles in an outward direction (to opposite sides to a direction heading toward a central axis).

The plugs, of which tip end sides are bent outward in this manner, are attached to the first lamp socket 27, and then clasps the power feeding contacts of the first lamp socket 27 with the bent portions of the plugs, and as a result, the plugs are attached to the first lamp socket 27. Hence, the bent portions of the plugs are hooked onto the power feeding contacts such that the lamp 10 is unlikely to become detached from the first lamp socket 27. Moreover, the electrical connection remains stable even when the lamp 10 is close to becoming detached from the first lamp socket 27, and therefore arc discharge is unlikely to occur.

(Third Embodiment)

When the straight tube 22 is formed from a translucent synthetic resin material, the straight tube LED lamp may move in the lengthwise direction as a result of bending, thermal expansion, and thermal contraction of the straight tube LED lamp.

Figure 19A:
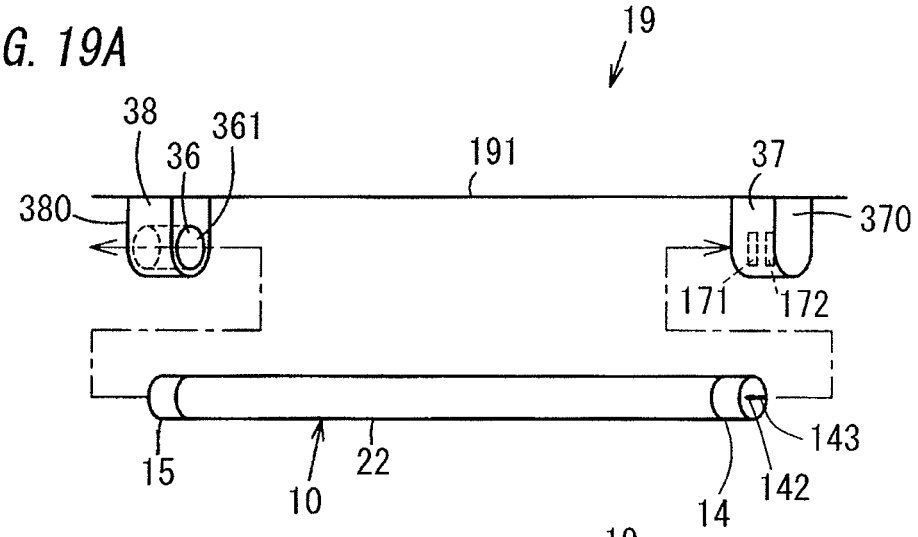
FIG. 19A is a side view showing a condition prior to attachment of a straight tube LED lamp to a lamp socket set and FIG. 19B is a side view showing a condition in which the straight tube LED lamp is attached to the lamp socket set.
Figure 19B:
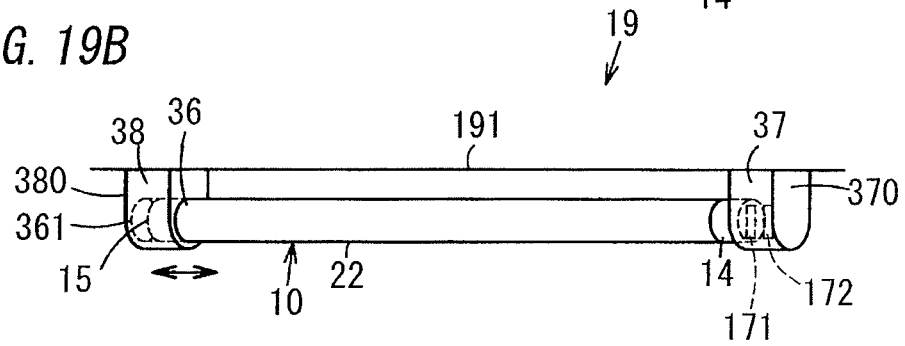

FIG. 19 shows a lighting fixture 19 for solving this problem. For the purpose of clarity, like kind elements are assigned the same reference numerals as depicted in first or second embodiment. The lighting fixture 19 is an embedded lighting fixture for one or a plurality of straight tube fluorescent lamps, and includes one or a plurality of straight tube LED lamps 10. The lighting fixture 19 is not limited to an embedded lighting fixture. The lighting fixture 19 may also be applied to a ceiling mounted lighting fixture.

The lighting fixture 19 includes an elongated casing 191 (see FIG. 9) that is embedded in a ceiling surface and has an open lower surface, first and second lamp sockets 37, 38 disposed on respective lengthwise direction ends of the casing 191 so as to oppose each other, and a lighting circuit (see FIG. 6, for example). Here, first and second caps 14, 15 of the lamp 10 are attached to the first and second lamp sockets 37, 38, respectively. The lighting circuit is a dedicated power supply disposed in the casing in order to light the lamp 10.

The lighting fixture 19 according to this embodiment is, for example, a redesigned lighting fixture 19 in which the casing 191 of a pre-installed lighting fixture for a straight tube fluorescent lamp is employed as is in combination with the lamp 10, and the first and second lamp sockets 37, 38 and lighting circuit used exclusively with the lamp 10. Alternatively, when the lighting fixture 19 employing the lamp 10, and the first and second lamp sockets 37, 38 and lighting circuit used exclusively with the lamp 10 is newly installed, an existing casing 191 for a straight tube fluorescent lamp may be reused and combined with the lamp 10, the first and second lamp sockets 37, 38, and the lighting circuit, as the lighting fixture 19 to be installed.

Figure 20:
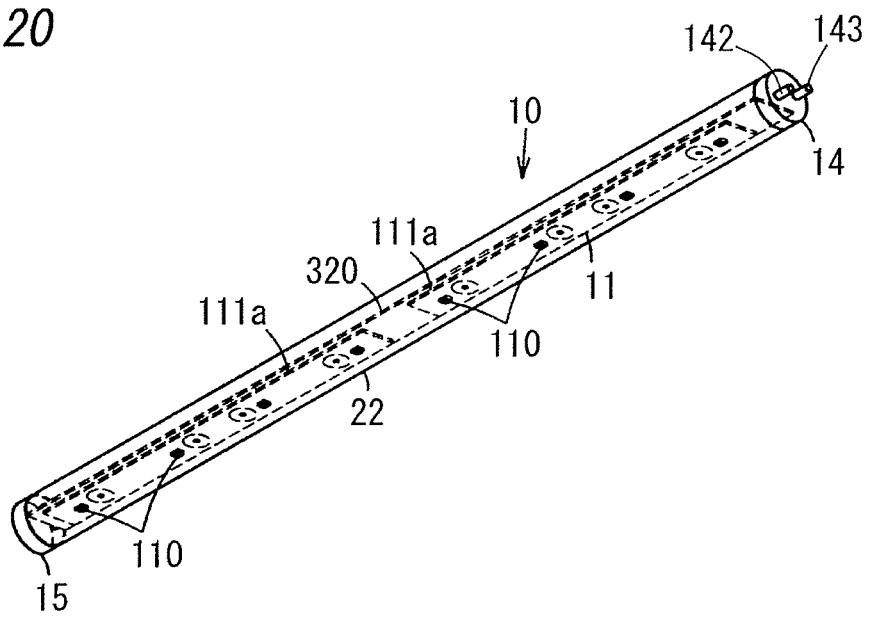
FIG. 20 is a perspective view of the straight tube LED lamp according to the third embodiment.

As shown in FIGS. 19 and 20, the lamp 10 includes a straight tube 22 formed to have a tube length and a tube diameter that are approximately identical to those of a straight tube fluorescent lamp and a substantially identical outer appearance to a straight tube fluorescent lamp, and an LED module 11 housed in the straight tube 22.

The lamp 10 includes the translucent straight tube 22 and the first and second caps 14, 15 provided to cover respective end portions of the straight tube 22. Each of the first and second caps 14, 15 serves as an end portion cap or an end portion cover.

The straight tube 22 is formed in an elongated cylindrical shape, for example, from a translucent and diffusive resin material such as acrylic resin.

Each of the first and second caps 14, 15 is formed from a synthetic resin material or a metallic material having an insulating property, for example. Note that the first and second caps 14, 15 may take any shape as long as they are capable of covering the end portions of the straight tube 22, and may include a part of the straight tube 22. Further, the first terminal (i.e. cap pins 142, 143) electrically connected to the LED module 11 projects from an end surface of the first cap 14. The cap pins 142, 143, similarly to a pair of cap pins projecting from a cap of a straight tube fluorescent lamp, are constituted by pins that project in parallel in the lengthwise direction of the lamp 10.

The LED module 11 includes, for example, a plurality of substrates 111*a* on which a plurality of LEDs 110 are mounted, and an attachment plate 320 to which the substrates 111*a* are attached. The attachment plate 320 is a conductor (a conductive member) such as a heat sink, a reflector, or a mechanism functioning as both a heat sink and a reflector. Similarly to the second embodiment, the conductor may be, but need not be, electrically connected to the second terminal of the second cap 15. The LED module 11 is housed in the straight tube 22 by inserting the LED module 11 from one end portion of the straight tube 22 and then attaching the first and second caps 14, 15 to the respective end portions of the straight tube 22.

An SMD (Surface Mount Device) package having a connection terminal and installed with an LED chip is used as the LED module 11. The SMD package is formed by disposing an LED chip that emits blue light, for example, in a package and sealing the LED chip using a fluorescent material layer made of silicone resin or the like, for example, into which yellow fluorescent material that emits yellow light when excited by a part of the blue light from the LED chip is intermixed. Thus, a surface of the fluorescent material layer serves as a light emitting surface, and white-based light is emitted from the light emitting surface.

Note that a positional relationship between the cap pins 142, 143 and the light emitting surface of the LEDs 110 on the LED module 11 is set such that when the lamp 10 is attached between the first and second lamp sockets 37, 38 correctly, the light emitting surface of the LEDs 110 is oriented downward so as to be capable of emitting light in a predetermined irradiation direction.

Further, as shown in FIG. 19, the first lamp socket 37 is a power feeding socket including a resin body 370 having an insulating property and a power feeding terminal that is housed in the body 370 and includes power feeding contacts 171, 172. A pair of insertion holes are formed in the body 370 in a lamp attachment surface, which is an inside surface opposing the second lamp socket 38, and the power feeding contacts 171, 172 are disposed inside the respective insertion holes. By inserting the cap pins 142, 143 of the lamp 10 into the pair of insertion holes, the cap pins 142, 143 are electrically connected to the power feeding contacts 171, 172. Alternatively, a vertical groove that opens onto and communicates with a tip end of the body 370 is formed in the lamp attachment surface of the body 370, a pair of arc-shaped grooves are formed to communicate with the vertical groove, and the power feeding contacts 171, 172 are disposed inside the arc-shaped grooves. In this case, the lamp 10 is rotated after inserting the cap pins 142, 143 into the vertical groove so that the cap pins 142, 143 move into the arc-shaped grooves, and as a result, the cap pins 142, 143 are electrically connected to the power feeding contacts 171, 172.

The second lamp socket 38 is a grounding and holding socket that includes a resin body 380 having an insulating property. A movement permitting portion 36 that holds the second cap 15 side of the lamp 10 while permitting the second cap 15 side to move in the lengthwise direction is formed in the body 380. The movement permitting portion 36 is formed from a circular holding hole 361 that penetrates the body 380 from a lamp attachment surface to an outside end surface, and the second cap 15 side of the lamp 10 is inserted into the holding hole 361 to be capable of moving in the lengthwise direction.

An interval between the opposing lamp attachment surfaces of the first and second lamp sockets 37, 38 is set to be smaller than an interval between respective outside end surfaces of the first and second caps 14, 15 of the lamp 10. Accordingly, when the lamp 10 is attached between the first and second lamp sockets 37, 38, the second cap 15 side of the lamp 10 is engaged with the holding hole 361 in the second lamp socket 38. A lengthwise direction engagement dimension between the attached lamp 10 and the second lamp socket 38 in the attached condition is set at least at a dimension ensuring that even when a location near the lengthwise direction center of the lamp 10 bends downward between the first and second lamp sockets 37, 38 or the lamp 10 undergoes thermal contraction at a low temperature, the lamp 10 does not fall out of the second lamp socket 38.

The lighting circuit receives input of a commercial alternating current power supply, converts the alternating current power into direct current power, and supplies the direct current power to the LED module 11 of the lamp 10 via the first terminal of the first lamp socket 37.

Hence, to redesign a pre-installed lighting fixture for a straight tube fluorescent lamp disposed in a ceiling surface, for example, either a straight tube fluorescent lamp lighting device is removed from the casing 191 or, in a case where the straight tube fluorescent lamp lighting device is to be left in place, a power supply line for supplying a commercial alternating current power supply is removed from the straight tube fluorescent lamp lighting device. Then, the lighting circuit used exclusively with the lamp 10 is newly attached to the casing 191 and a power supply line is connected to the lighting circuit.

Straight tube fluorescent lamp sockets are then removed from the casing 191, whereupon the first and second lamp sockets 37, 38 are attached to the casing 191 and the lighting circuit is electrically connected to the first lamp socket 37 by a wire.

The lamp 10 is then attached between the first and second lamp sockets 37, 38 of the casing 191. At this time, the second cap 15 side of the lamp 10 is inserted into the holding hole 361 in the second lamp socket 38 such that the entire lamp 10 is shifted to the second lamp socket 38 side, whereupon the cap pins 142, 143 projecting from the first cap 14 of the lamp 10 are inserted into the insertion holes in the first lamp socket 37 and electrically connected to the power feeding terminal (the power feeding contacts 171, 172). At this time, the lamp 10 is attached such that the light emitting surfaces of the LEDs 110 in the LED module 11 are oriented downward in an illumination direction on an opposite side to the casing 191.

When the lamp 10 is attached between the first and second lamp sockets 37, 38, the first lamp socket 37 supports the first cap 14 of the lamp 10 and restricts movement, including lengthwise direction movement, of the lamp 10, while the second lamp socket 38 supports the second cap 15 of the lamp 10 but permits lengthwise direction movement of the lamp 10.

Further, when the lamp 10 is attached between the first and second lamp sockets 37, 38, a weight thereof causes a location near the lengthwise direction center to bend downward, the lamp 10 undergoes thermal contraction at low temperatures. However, lengthwise direction movement of the second cap 15 side of the lamp 10 relative to the second lamp socket 38 is permitted. Hence, although the second cap 15 side of the lamp 10 moves in a direction for becoming detached from the second lamp socket 38 due to bending or thermal contraction of the lamp 10, the lengthwise direction engagement dimension between the attached lamp 10 and the second lamp socket 38 in the attached condition is set at least at a dimension ensuring that the lamp 10 does not fall out of the second lamp socket 38, as described above, and therefore the lamp 10 is held securely without falling out of the second lamp socket 38.

When the lighting circuit is operated, direct current power from the lighting circuit is supplied to the LED module 11 of the lamp 10 via the first lamp socket 37, thereby lighting the respective LEDs 110 of the LED module 11. The light emitted by the LEDs 110 passes through the straight tube 22 so as to be emitted in the predetermined irradiation direction downward of the lighting fixture 19.

When the lamp 10 is lit, the lamp 10 undergoes thermal expansion due to an effect of the heat generated by the LEDs 110. The lamp 10 expands by the greatest degree in the lengthwise direction due to thermal expansion of the resin straight tube 22. At this time, lengthwise direction movement of the second cap 15 side of the lamp 10 relative to the second lamp socket 38 is permitted, and therefore lengthwise direction expansion of the lamp 10 due to thermal expansion can be absorbed. As a result, a load is not exerted on the lamp 10 and the first and second lamp sockets 37, 38, and therefore these components do not break.

Hence, with the lighting fixture 19 according to this embodiment, by attaching the lamp 10 between the first lamp socket 37 that restricts lengthwise direction movement of the lamp 10 and the second lamp socket 38 that permits lengthwise direction movement of the lamp 10, the lamp 10 can be held securely between the first and second lamp sockets 37, 38 in a condition where lengthwise direction movement of the lamp 10 accompanying bending, thermal expansion, and thermal contraction of the lamp 10 is permitted.

Further, the second cap 15 side of the lamp 10 and the second lamp socket 38 constitute an attachment structure for attaching the lamp 10 to be capable of rotating about the tube axis thereof. Thus, when the cap pins 142, 143 projecting from the first cap 14 of the lamp 10 are attached to the first lamp socket 37 by being rotated, rotation of the lamp 10 can be permitted, and moreover, resistance to rotation of the lamp 10 can be reduced, enabling an improvement in operability. In other words, with this attachment structure, the second cap 15 of the lamp 10 is not symmetrical, and therefore, even though the first cap 14 is symmetrical due to the projecting cap pins 142, 143, an orientation relationship between the first cap 14 and the second cap 15 does not have to be taken into consideration during manufacture, enabling an improvement in ease of manufacture.

Figure 21:
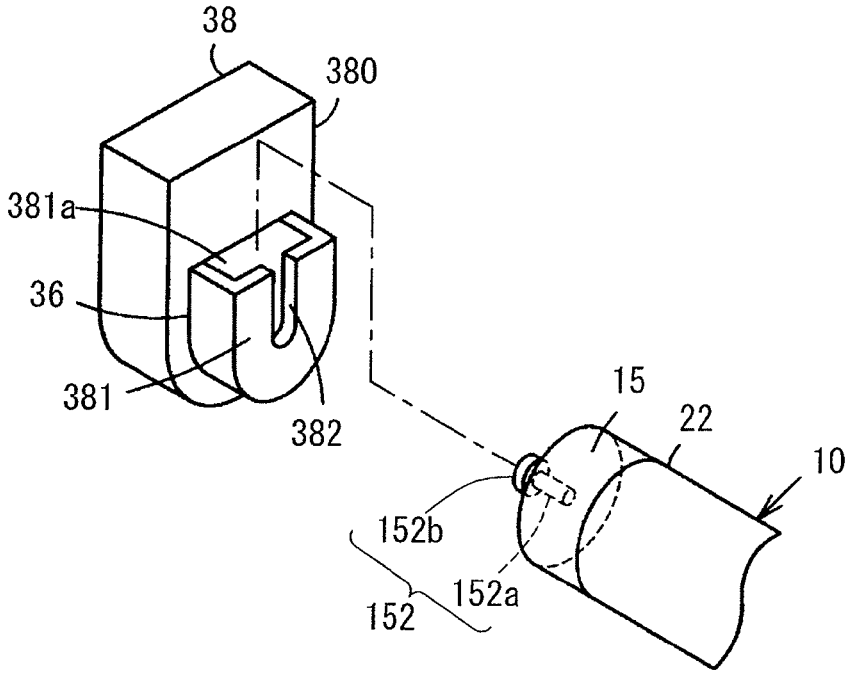
FIG. 21 is a partial perspective view of a second lamp socket and a straight tube LED lamp, illustrating a lighting fixture according to an embodiment.

In an embodiment, the lighting fixture has an earth connection structure shown in FIG. 21. The second cap 15 of the lamp 10 includes a second terminal 152, which is constituted by a shaft portion 152*a* provided to project from the center of the end surface of the second cap 15 of the lamp 10 and a latch portion 152*b* serving as a disc-shaped hook portion formed on a tip end of the shaft portion 152*a*. Similarly to the second lamp socket 18 shown in FIG. 5, a lamp attachment portion 381 that is biased to the second cap 15 side by a biasing body projects from the second surface of the body 380 of the second lamp socket 38. An insertion portion 381*a* into which the latch portion 152*b* serving as the hook portion can be inserted is formed in the lamp attachment portion 381 between an end surface of the lamp attachment portion 381 and the second surface of the body 380. Further, an insertion groove 382 through which the shaft portion 152*a* passes is formed in a vertical direction in the end surface of the lamp attachment portion 381 so as to communicate with the insertion portion 381*a*.

To attach the lamp 10 in this embodiment, the latch portion 152*b* projecting from the second cap 15 of the lamp 10 is inserted into the insertion portion 381*a* of the lamp attachment portion 381 of the second lamp socket 38 from above, and the shaft portion 152*a* is inserted into the insertion groove 382 from above. The lamp attachment portion 381 is then pushed into the body 380 against the bias, whereupon the cap pins 142, 143 projecting from the first cap 14 of the lamp 10 are inserted into the insertion holes in the first lamp socket 37 while the entire lamp 10 is shifted to the second lamp socket 38 side.

With this configuration, even if the first cap 14 side of the lamp 10 becomes detached from the first lamp socket 37, the latch portion 152*b* of the second cap 15 is hooked to the second lamp socket 38, and therefore the lamp 10 can be reliably prevented from falling. Hence, the earth connection structure doubles as a falling prevention structure. Likewise in this case, as described above, the second cap 15 of the lamp 10 and the second lamp socket 38 constitute an attachment structure for attaching the lamp 10 to be capable of rotating about the tube axis thereof.

In an embodiment, the lamp 10 includes a polarity control circuit for ensuring that the cap pins 142, 143 do not have an exclusive positive or negative polarity. By providing the polarity control circuit, the lamp 10 can be lit regardless of whether each of the cap pins 142, 143 is connected to either of a positive power feeding contact or a negative power feeding contact, for example. Alternatively, it is possible to ensure that the lamp 10 is not lit when the cap pins 142, 143 are connected to the wrong polarity, and that the LED module 11 and so on are not affected thereby.

(Fourth Embodiment)

Figure 22:
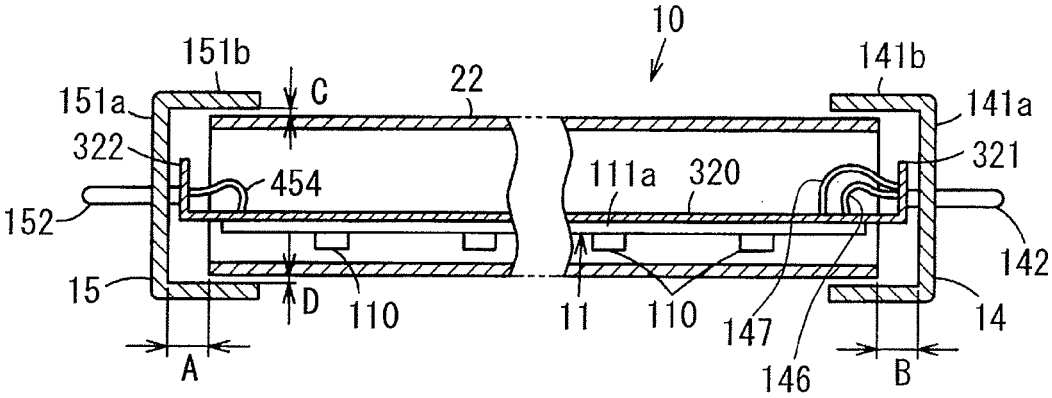
FIG. 22 is a partially omitted sectional view of a straight tube LED lamp according to a fourth embodiment.

FIG. 22 shows a straight tube LED lamp 10 according to a fourth embodiment. For the purpose of clarity, like kind elements are assigned the same reference numerals as depicted in first to third embodiments. The lamp 10 includes a straight tube 22 formed to have a tube length and a tube diameter that are approximately identical to those of a straight tube fluorescent lamp and a substantially identical outer appearance to a straight tube fluorescent lamp, and an LED module 11 housed in the straight tube 22.

The lamp 10 includes the translucent straight tube 22 and first and second caps 14, 15 provided to close respective end portions of the straight tube 22. The first and second caps 14, 15 respectively serve as caps or end portion caps.

The straight tube 22 is formed in an elongated cylindrical shape, for example, from a translucent and diffusive resin material such as acrylic resin, for example.

The first and second caps 14, 15 are formed in a cap shape from a synthetic resin material having an insulating property, for example, and respectively include disc-shaped end surface portions 141*a*, 151*a* covering the end surfaces of the straight tube 22 and peripheral surface portions 141*b*, 151*b* formed in a ring shape on respective peripheral edge portions of the end surface portions 141*a*, 151*a*. The peripheral surface portions 141*b*, 151*b* are formed such that an inner diameter thereof is larger than an outer diameter of the straight tube 22. A pair of cap pins (the first terminal) 142, 143 (see FIG. 7) for power feeding, which are electrically connected to the LED module 11, project from an end surface of the first cap 14 in parallel in the lengthwise direction of the lamp 10. Further, a single cap pin (the second terminal) 152, which serves as an earth pin for establishing an earth connection, projects from an end surface of the second cap 15 in the lengthwise direction of the lamp 10 in alignment with the tube axis of the lamp 10.

The LED module 11 includes, for example, a plurality of elongated substrates 111*a* on which LEDs 110 are mounted, and an elongated attachment plate 320 to which the substrates 111*a* are attached. The attachment plate 320 is a conductor (a conductive member) such as a heat sink, a reflector, or a mechanism functioning as both a heat sink and a reflector. Similarly to the second embodiment, the conductor may be, but need not be, electrically connected to the second terminal of the second cap 15.

An SMD (Surface Mount Device) package having a connection terminal and installed with an LED chip is used as the LED module 11. The SMD package is formed by disposing an LED chip that emits blue light, for example, in a package, and sealing the LED chip using a fluorescent material layer made of silicone resin or the like, for example, into which yellow fluorescent material that emits yellow light when excited by a part of the blue light from the LED chip is intermixed. Thus, a surface of the fluorescent material layer serves as a light emitting surface, and white-based light is emitted from the light emitting surface.

The attachment plate 320 is made of metal, for example, and formed such that a lengthwise direction length thereof is greater than a lengthwise direction length of the straight tube 22. Respective end portions of the attachment plate 320 are bent substantially at right angles toward an opposite surface side to a surface side on which the LEDs 110 are disposed.

The pair of cap pins 142, 143 are fixed to an outer end surface of an attachment portion 321 on one end of the attachment plate 320. The cap pin 152 is fixed to an outer end surface of an attachment portion 322 on another end of the attachment plate 320. As a result, the attachment plate 320 of the LED module 11 and the respective cap pins are integrated. Note that the attachment plate 320 and the respective cap pins (or the first terminal) are fixed so as to be insulated from each other.

The cap pins 142, 143 and the substrates 111*a* are electrically connected by lead wires 146, 147 such that power can be fed from the cap pins 142, 143 to the respective LEDs 110 mounted on the substrates 111*a*. The cap pin 152 and a part of the substrates 111*a* having an earth potential are electrically connected by a lead wire 454.

The LED module 11 is inserted into the straight tube 22 from one end portion thereof, whereupon the first cap 14 and the second cap 15 are fixed respectively to the cap pins 142, 143 and the cap pin 152 so as to cover the respective ends of the straight tube 22. Thus, the LED module 11 is housed in the lamp 10 constituted by the straight tube 22 and the first and second caps 14, 15.

The first cap 14 is fixed to the cap pins 142, 143 by joint fixing, for example, whereby the cap pins 142, 143 are press-fitted into respective hole portions formed in the first cap 14. Similarly, the second cap 15 is fixed to the cap pin 152 by joint fixing, for example, whereby the cap pin 152 is press-fitted into a hole portion formed in the second cap 15. As a result, the attachment plate 320 of the LED module 11 is integrated with the first and second caps 14, 15.

The straight tube 22 is held between the first and second caps 14, 15 to be capable of moving within a predetermined range in the lengthwise direction and the radial direction relative to the LED module 11 and the first and second caps 14, 15.

More specifically, a predetermined interval A+B allowing the straight tube 22 to expand and contract while reducing or eliminating an effect thereof is provided in the lengthwise direction of the lamp 10 between the end portions of the straight tube 22 and respective inner surfaces of the end surface portions 141*a*, 151*a* of the first and second caps 14, 15. Further, a predetermined interval C+D allowing the straight tube 22 to expand and contract while reducing or eliminating an effect thereof is provided in the radial direction of the lamp 10 between an outer peripheral surface of the straight tube 22 and respective inner peripheral surfaces of the peripheral surface portions 141*b*, 151*b* of the first and second caps 14, 15.

Hence, the lengthwise direction length of the straight tube 22 is shorter than a length between the mutually opposing inner surfaces of the end surface portions 141*a*, 151*a* of the first and second caps 14, 15, and the outer diameter of the straight tube 22 is smaller than the respective inner diameters of the peripheral surface portions 141*b*, 151*b* of the first and second caps 14, 15.

Note, however, that the lengthwise direction length of the straight tube 22 is longer than a length between mutually opposing tip end surfaces of the peripheral surface portions 141*b*, 151*b* of the first and second caps 14, 15 and longer than a length by which the inner surface of the end surface portion of one of the first and second caps 14, 15 and the tip end surface of the peripheral surface portion of the other oppose each other. Therefore, the straight tube 22 does not become detached between the peripheral surface portions 141*b*, 151*b* of the first and second caps 14, 15.

In another configuration, for example, only one end side of the straight tube 22 is held by the first cap 14 while the other end side of the straight tube 22 is capable of moving relative to the second cap 15 and the LED module 11.

Further, a positional relationship between the cap pins 142, 143 and the respective light emitting surfaces of the LEDs 110 on the LED module 11 is set such that when the lamp 10 is attached between the first and second lamp sockets in a correct attachment position, the respective light emitting surfaces of the LEDs 110 are oriented downward from the lighting fixture so as to be capable of emitting light in the predetermined irradiation direction.

When the lamp 10 is lit, the LEDs 110 generate heat, and this heat is transmitted to the LED module 11 and the straight tube 22. The straight tube 22 is made of resin and is therefore particularly likely to undergo dramatic thermal expansion due to the effect of the heat from the LEDs 110. The thermally expanding straight tube 22 expands in the lengthwise direction and increases in diameter in the radial direction.

At this time, the interval A+B is provided in the lengthwise direction between the straight tube 22 and the first and second caps 14, 15, and therefore the straight tube 22 is permitted to expand in the lengthwise direction due to thermal expansion without exerting a load on the first and second caps 14, 15. Further, the interval C+D is provided in the radial direction between the straight tube 22 and the first and second caps 14, 15, and therefore the straight tube 22 is permitted to increase in diameter in the radial direction due to thermal expansion without exerting a load on the first and second caps 14, 15. Hence, even when the straight tube 22 undergoes thermal expansion, a load is not exerted on the lamp 10, including the first and second caps 14, 15 and the LED module 11, the first and second lamp sockets, and so on, and therefore these components do not break.

At a low temperature when the lamp 10 is extinguished, on the other hand, the straight tube 22 undergoes thermal contraction, in contrast to a high temperature. However, the straight tube 22 is disposed between the first and second caps 14, 15 and does not therefore become detached between the peripheral surface portions 141*b*, 151*b* of the first and second caps 14, 15 when undergoing thermal contraction.

Hence, in the lamp 10 according to this embodiment, the first and second caps 14, 15 covering the end portions of the straight tube 22 are integrated with the LED module 11 such that movement of the straight tube 22 relative to the first and second caps 14, 15 is permitted, and as a result, even when the straight tube 22 undergoes thermal expansion and thermal contraction, it is possible to prevent the LED module 11 and the first and second caps 14, 15 from being affected thereby.

Moreover, the respective cap pins are also integrated with the LED module 11, and therefore connections between the respective cap pins and the first and second lamp sockets are not affected even when the straight tube 22 undergoes thermal expansion and thermal contraction. As a result, the reliability of the connections can be improved.

In another configuration, one end portion of the straight tube 22 may be fixed to one of the first and second caps 14, 15 such that only the other end portion of the straight tube 22 can move relative to the other of the first and second caps 14, 15 and the LED module 11. Likewise in this case, movement of the straight tube 22 due to thermal expansion and thermal contraction can be permitted.

Further, the lamp 10 may include a polarity control circuit for ensuring that the cap pins 142, 143 do not have an exclusive positive or negative polarity. By providing the polarity control circuit, the lamp 10 can be lit regardless of whether each of the cap pins 142, 143 is connected to either of a positive power feeding contact or a negative power feeding contact, for example. Alternatively, it is possible to ensure that the lamp 10 is not lit when the cap pins 142, 143 are connected to the wrong polarity, and that the LED module 11 and so on are not affected thereby.

(Fifth Embodiment)

Figure 23:
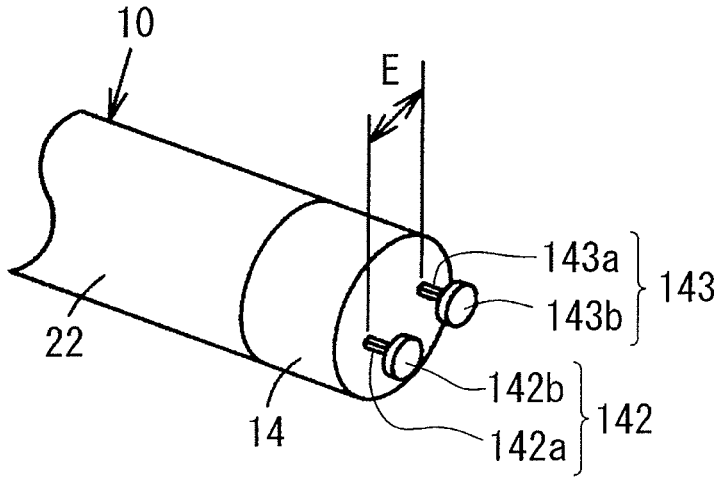
FIG. 23 is a partial perspective view of a straight tube LED lamp according to a fifth embodiment.
Figure 24:
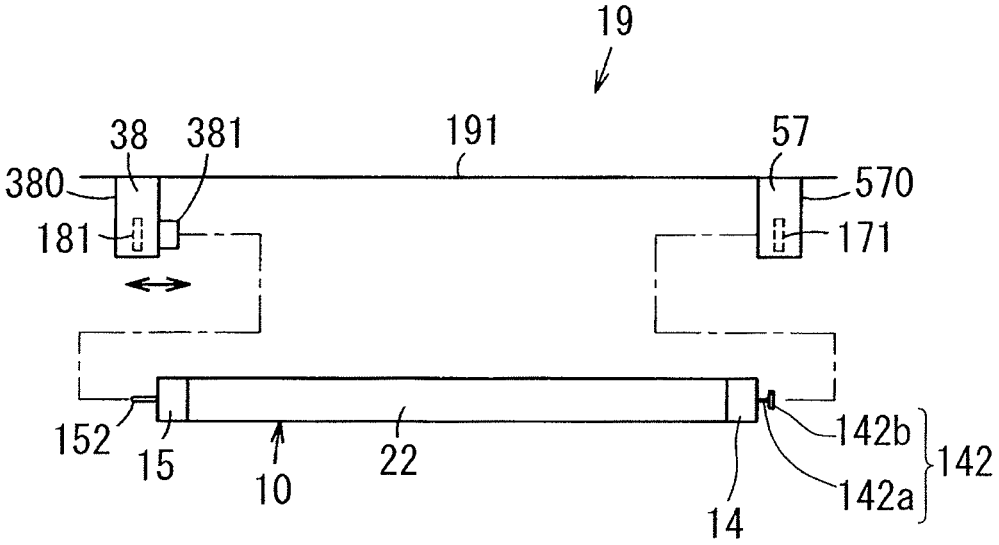
FIG. 24 is a side view of a lighting fixture using the straight tube LED lamp according to the fifth embodiment.

FIGS. 23 and 24 show a straight tube LED lamp 10 according to a fifth embodiment. For the purpose of clarity, like kind elements are assigned the same reference numerals as depicted in the first to fourth embodiments. The lamp 10 includes a straight tube 22 formed to have a tube length and a tube diameter that are approximately identical to those of a straight tube fluorescent lamp and a substantially identical outer appearance to a straight tube fluorescent lamp, and an LED module (see FIG. 20, for example) housed in the straight tube 22.

The lamp 10 includes the translucent straight tube 22 and first and second caps 14, 15 provided to cover respective end portions of the straight tube 22. The first and second caps 14, 15 respectively serve as end portion caps or end portion covers.

The straight tube 22 is formed in an elongated cylindrical shape, for example, from a translucent and diffusive resin material such as acrylic resin, for example.

The first and second caps 14, 15 are formed from a synthetic resin material or a metallic material having an insulating property, for example. Note that the first and second caps 14, 15 may take any shape as long as they are capable of covering the end portions of the straight tube 22, and may include a part of the straight tube 22.

Cap pins (the first terminal) 142, 143 for power feeding, which are electrically connected to the LED module, project from an end surface of the first cap 14. The cap pins 142, 143 respectively include shaft portions 142*a*, 143*a* that project in the lengthwise direction of the lamp 10 and disc-shaped latch portions (connecting portions) 142*b*, 143*b* that project sideward relative to the lengthwise direction of the shaft portions 142*a*, 143*a* from respective tip ends of the shaft portions 142*a*, 143*a*. An interval between the cap pins 142, 143, or in other words an interval E between respective centers of the shaft portions 142*a*, 143*a*, is set to be wider than an interval between a pair of cap pins of a G13 type cap defined in JISC7709-1 (IEC60061-1).

A single cap pin (an earth pin, the second terminal) 152 for establishing an earth connection projects from an end surface of the second cap 15 in the lengthwise direction of the lamp 10 in alignment with the tube axis of the lamp 10.

The LED module includes, for example, a plurality of substrates on which LEDs 110 are mounted, and an attachment plate to which the substrates are attached (see FIGS. 20 and 22). The LED module is housed in the lamp 10 by inserting the LED module from one end portion of the straight tube 22 and then attaching the first and second caps 14, 15 to the respective end portions of the straight tube 22.

An SMD (Surface Mount Device) package having a connection terminal and installed with an LED chip is used for the LEDs 110. The SMD package is formed by disposing an LED chip that emits blue light, for example, in a package and sealing the LED chip using a fluorescent material layer made of silicone resin or the like, for example, into which yellow fluorescent material that emits yellow light when excited by a part of the blue light from the LED chip is intermixed. Thus, a surface of the fluorescent material layer serves as a light emitting surface, and white-based light is emitted from the light emitting surface.

Note that a positional relationship between the cap pins 142, 143 and the respective light emitting surfaces of the LEDs 110 in the LED module is set such that when the lamp 10 is attached between first and second lamp sockets 57, 38 correctly, the respective light emitting surfaces of the LEDs 110 are oriented downward so as to be capable of emitting light in the predetermined irradiation direction.

Figure 25:
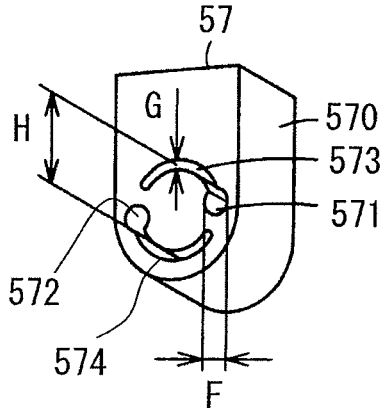
FIG. 25 is a perspective view of a first lamp socket of the lighting fixture according to the fifth embodiment.

Further, as shown in FIG. 25, the first lamp socket 57 is a power feeding socket including a resin body 570 having an insulating property and a power feeding terminal that is housed in the body 570. The power feeding terminal is constituted by a pair of power feeding contacts, for example (see FIG. 19).

Circular hole-shaped insertion portions 571, 572 are formed in the body 570 in a second surface (a lamp attachment surface), which is an inner surface opposing the second lamp socket 38, at a width dimension F that allows insertion of the latch portions 142*b*, 143*b* on the cap pins 142, 143 of the lamp 10, and passage portions 573, 574 having a width dimension G, which is narrower than the width of the latch portions 142*b*, 143*b* on the cap pins 142, 143 but wide enough to allow the shaft portions 142*a*, 143*a* to pass through, are formed to communicate with the insertion portions 571, 572. The width dimension F of the insertion portions 571, 572 and the width dimension G of the passage portions 573, 574 have a relationship of F>G. The passage portions 573, 574 take the form of arc-shaped grooves permitting rotation of the cap pins 142, 143 about the tube axis of the lamp 10. An interval H between respective centers of the grooves forming the passage portions 573, 574 is set to be identical to the interval between the cap pins 142, 143, or in other words the interval E between the respective centers of the shaft portions 142*a*, 143*a*, and wider than an interval between a pair of passage portions formed as holes or grooves in a socket for connecting a pair of cap pins of a G13 type cap.

Power feeding contacts are housed in the body 570 and disposed in positions of the passage portions 573, 574 through which the respective shaft portions 142*a*, 143*a* of the cap pins 142, 143 pass so as to be electrically connected to the latch portions 142*b*, 143*b* on the cap pins 142, 143 in positions deviating to an outer side (an outer diameter side, for example) of positions opposing the passage portions 573, 574.

Further, as shown in FIG. 24, the second lamp socket 38 is a holding and earth connection socket that includes a resin body 380 having an insulating property, and a grounding contact 181 housed in the body 380 as a grounding terminal.

The body 380 includes a lamp attachment portion 381 that is capable of advancing and retreating into and from a second surface (a lamp attachment surface), which is an inner surface opposing the first lamp socket 57. A single insertion hole into which the cap pin 152 of the lamp 10 is inserted is formed in a center of the lamp attachment portion 381, and the grounding contact 181 that is electrically connected to the cap pin 152 is disposed inside the insertion hole. The lamp attachment portion 381 is biased in a projecting direction from the body 380 by the grounding contact 181 or a separate spring disposed in the body 380. The grounding contact 181 is electrically connected to a casing 191 or the like of a lighting fixture 19.

A straight tube fluorescent lamp socket is detached from the casing 191, the first and second lamp sockets 57, 38 are attached to the casing 191, and a lighting circuit (see FIG. 6) is electrically connected to the first lamp socket 57 by a wire.

The lamp 10 is then attached between the first and second lamp sockets 57, 38 of the casing 191. At this time, the single cap pin 152 projecting from the second cap 15 of the lamp 10 is inserted into the insertion hole in the lamp attachment portion 381 of the second lamp socket 38 such that the lamp attachment portion 381 is pushed into the body 380 against the bias, whereupon the latch portions 142*b*, 143*b* on the cap pins 142, 143 projecting from the first cap 14 of the lamp 10 are respectively inserted into the insertion portions 571, 572 of the first lamp socket 57 and the shaft portions 142*a*, 143*a* of the cap pins 142, 143 are also inserted into the insertion portions 571, 572 while the entire lamp 10 is shifted to the second lamp socket 38 side. Next, the lamp 10 is rotated in the attachment direction about the tube axis such that the shaft portions 142*a*, 143*a* of the cap pins 142, 143 move through the passage portions 573, 574, and as a result, the lamp 10 is attached in a predetermined attachment position between the first and second lamp sockets 57, 38.

When the lamp 10 is attached, the cap pin 152 is connected to the grounding contact 181 on the second lamp socket 38 side, and the power feeding contacts on the first lamp socket 57 side are electrically connected to the respective latch portions 142*b*, 143*b* of the cap pins 142, 143 in positions deviating to the outer side (the outer diameter side, for example) of the positions opposing the passage portions 573, 574 through which the shaft portions 142*a*, 143*a* of the cap pins 142, 143 pass.

When the lighting circuit is operated, direct current power from the lighting circuit is supplied to the LED module via the pair of power feeding contacts of the first lamp socket 57 and the cap pins 142, 143 of the lamp 10, thereby lighting the respective LEDs 110 of the LED module. The light emitted by the LEDs 110 passes through the straight tube 22 so as to be emitted in the predetermined irradiation direction downward of the lighting fixture 19.

To detach the lamp 10, the lamp 10 is rotated in a detachment direction, which is an opposite direction to the attachment direction, about the tube axis such that the lamp attachment portion 381 is pushed into the body 380 against the bias, whereupon the cap pins 142, 143 of the first cap 14 are withdrawn from the insertion portions 571, 572 of the first lamp socket 57 while the entire lamp 10 is shifted to the second lamp socket 38 side. The first cap 14 side of the lamp 10 is then moved downward such that the cap pin 152 of the second cap 15 is withdrawn from the second lamp socket 38.

Further, the lamp 10 includes the first cap 14 from which the cap pins 142, 143 project at a wider interval than an interval between a pair of cap pins prescribed for a G13 type cap for a straight tube fluorescent lamp, and therefore the lamp 10 is not compatible with a G13 type cap. Hence, when an attempt is made to attach the lamp 10 to a pre-existing lighting fixture for a straight tube fluorescent lamp by mistake, the lamp 10 can be reliably prevented from being attached to a socket corresponding to a G13 type cap.

Further, by providing the latch portions 142*b*, 143*b* that project sideward relative to the lengthwise direction of the cap pins 142, 143 on the respective tip ends of the cap pins 142, 143, the lamp 10 can be prevented from being attached to a socket corresponding to a G13 type cap even more reliably.

Furthermore, the interval between the cap pins 142, 143 is wide, and therefore a creeping distance between the cap pins 142, 143 to which positive and negative direct current power is respectively supplied can be increased. As a result, an insulating property can be secured.

Further, the first lamp socket 57 to which the first cap 14 of the lamp 10 is attached includes the insertion portions 571, 572 into which the latch portions 142*b*, 143*b* on the cap pins 142, 143 of the lamp 10 can be inserted, and the passage portions 573, 574 that are formed to communicate with the insertion portions 571, 572 at a dimension that is narrower than the width of the latch portions 142*b*, 143*b* on the cap pins 142, 143 but wide enough to allow the shaft portions 142*a*, 143*a* to pass through. Moreover, the interval between the passage portions 573, 574 is set to be identical to the interval between the cap pins 142, 143 but wider than an interval between a pair of passage portions such as holes or grooves provided in a socket connected to a pair of cap pins of a G13 type cap. Thus, a straight tube fluorescent lamp can be reliably prevented from being attached to the first lamp socket 57.

Furthermore, the power feeding contacts housed in the first lamp socket 57 are disposed in the positions of the passage portions 573, 574 through which the respective shaft portions 142*a*, 143*a* of the cap pins 142, 143 pass so as to be electrically connected to the latch portions 142*b*, 143*b* on the cap pins 142, 143 in positions deviating to the outer side (the outer diameter side, for example) of the positions opposing the passage portions 573, 574. Therefore, even when straight cap pins of a G13 type cap are forcibly inserted into the passage portions 573, 574, it is possible to prevent the cap pins from being electrically connected to the power feeding contacts reliably.

As described above, by employing the lamp 10 and the first lamp socket 57 to which the lamp 10 is connected, compatibility with a straight tube fluorescent lamp and a socket to which a straight tube fluorescent lamp is connected can be eliminated, and as a result, mistaken attachment of the lamp 10 thereto can be reliably prevented.

Figure 26:
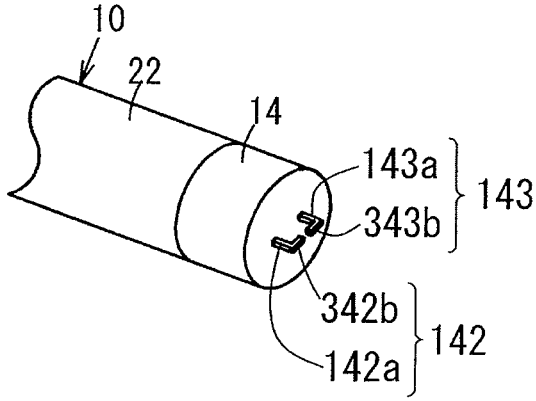
FIG. 26 is a partial perspective view of a straight tube LED lamp according to an embodiment.

In an embodiment, as shown in FIG. 26, the cap pins 142, 143 respectively include latch portions 342*b*, 343*b* that are provided on the respective tip ends of the shaft portions 142*a*, 143*a* projecting in the lengthwise direction of the lamp 10 and bent sideward relative to the lengthwise direction of the shaft portions 142*a*, 143*a* substantially into L shapes in mutually opposing (approaching) directions. With this configuration also, similar actions and effects to the fifth embodiment are obtained.

Figure 27:
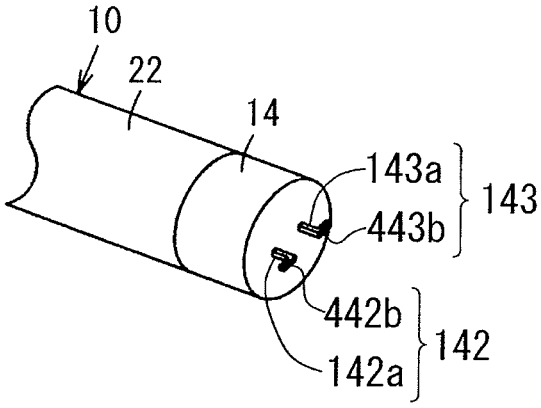
FIG. 27 is a partial perspective view of a straight tube LED lamp according to an embodiment.

In an embodiment, as shown in FIG. 27, the cap pins 142, 143 respectively include latch portions 442*b*, 443*b* that are provided on the respective tip ends of the shaft portions 142*a*, 143*a* projecting in the lengthwise direction of the lamp 10 and bent sideward relative to the lengthwise direction of the shaft portions 142*a*, 143*a* substantially into L shapes in opposite directions. With this configuration also, similar actions and effects to the fifth embodiment are obtained.

Figure 28:
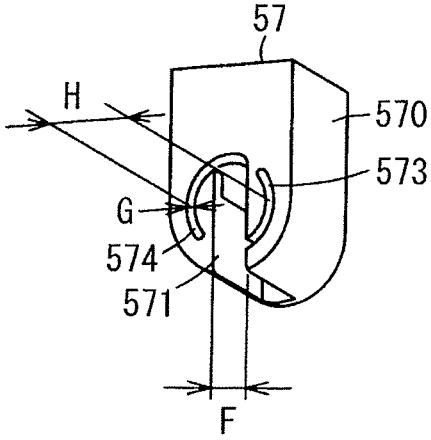
FIG. 28 is a perspective view of a first lamp socket according to an embodiment.

In an embodiment, as shown in FIG. 28, a single groove-shaped insertion portion 571 having the width dimension F enabling insertion of the latch portions 142*b*, 143*b* on the cap pins 142, 143 of the lamp 10 is formed in the body 570 of the first lamp socket 57 from a second surface (a lamp attachment surface), i.e. an inner surface opposing the second lamp socket 38, to a tip end surface, and the passage portions 573, 574 having the width dimension G, which is narrower than the width of the latch portions 142*b*, 143*b* on the cap pins 142, 143 but wide enough to allow the shaft portions 142*a*, 143*a* to pass through, are formed to communicate with the insertion portion 571. The width dimension F of the insertion portion 571 and the width dimension G of the passage portions 573, 574 have a relationship of F>G. The passage portions 573, 574 take the form of arc-shaped grooves that permit rotation of the cap pins 142, 143 about the tube axis of the lamp 10. The interval H between the respective centers of the grooves forming the passage portions 573, 574 is set to be identical to the interval between the cap pins 142, 143, or in other words the interval E between the respective centers of the shaft portions 142*a*, 143*a*, and wider than an interval between a pair of passage portions formed as holes or grooves in a socket for connecting a pair of cap pins of a G13 type cap.

The power feeding contacts (see FIG. 19) are housed in the body 570 and disposed in the positions of the passage portions 573, 574 through which the respective shaft portions 142*a*, 143*a* of the cap pins 142, 143 pass so as to be electrically connected to the latch portions 142*b*, 143*b* of the cap pins 142, 143 in positions deviating to the outer side (the outer diameter side, for example) of the positions opposing the passage portions 573, 574. The cap pins of the lamp 10 shown in FIGS. 23, 26 and 27 can be attached to the first lamp socket 57.

To attach the lamp 10, the cap pins (142, 143 in FIG. 23, for example) are inserted into the insertion portion 571 from a tip end side of the body 570, whereupon the lamp 10 is rotated in the attachment direction about the tube axis. As a result, in the case of the lamp 10 shown in FIGS. 23, 26 and 27, the shaft portions 142*a*, 143*a* of the cap pins 142, 143 move through the passage portions 573, 574, whereby the lamp 10 can be attached in a predetermined attachment position of the first lamp socket 57.

Hence, the first lamp socket 57 can be applied in common to various variations of the cap pins 143, 143 of the lamp 10, enabling an improvement in versatility.

Further, the lamp 10 may include a polarity control circuit for ensuring that the cap pins 142, 143 do not have an exclusive positive or negative polarity. By providing the polarity control circuit, the lamp 10 can be lit regardless of whether each of the cap pins 142, 143 is connected to either of a positive power feeding contact or a negative power feeding contact, for example. Alternatively, it is possible to ensure that the lamp 10 is not lit when the cap pins 142, 143 are connected to the wrong polarity, and that the LED module and so on are not affected thereby.

Although the present invention has been described with reference to certain preferred embodiments, numerous modifications and variations can be made by those skilled in the art without departing from the true spirit and scope of this invention, namely claims.

The invention claimed is:

1. A straight tube LED lamp comprising:

a straight tube in which a plurality of light emitting diodes are housed;

a first cap that provides a power feeding connection to the plurality of light emitting diodes, said first cap being provided on one axial direction end side of the straight tube;

a second cap provided on another axial direction end side of the straight tube;

a first terminal that provides an electrical connection to a terminal of a first lamp socket, the first terminal being provided in the first cap; and a second terminal that provides an electrical connection to a terminal of a second lamp socket, the second terminal being provided in the second cap, wherein the first terminal comprises two cap pins connected respectively to a positive electrode side and a negative electrode side of a direct current power supply via the first lamp socket, and latch portions extending sideward are provided on respective tip ends of the two cap pins.

2. The straight tube LED lamp according to claim 1, further comprising a conductor, wherein the second terminal is electrically connected to the conductor.

3. The straight tube LED lamp according to claim 1, further comprising a conductor, wherein the conductor has an elongated shape and comprises a part of the straight tube.

4. The straight tube LED lamp according to claim 3, wherein the plurality of light emitting diodes are mounted on an elongated substrate in a lengthwise direction of the elongated substrate, to comprise an LED module, and the conductor is a heat sink disposed in thermal contact with the LED module.

5. The straight tube LED lamp according to claim 1, wherein the two cap pins project from the first cap at a wider interval than an interval between two cap pins prescribed for a G13 type cap.

6. The straight tube LED lamp according to claim 1, wherein the latch portions of the two cap pins are bent so as to be oriented in opposite directions to each other.

7. The straight tube LED lamp according to claim 1, wherein, in an end surface of the first cap, recessed portions are provided on both sides of a central portion in a diameter direction, and the first terminal is provided in the central portion.

8. The straight tube LED lamp according to claim 1, wherein at least one of the first cap and the second cap covers an end portion of the straight tube so that the straight tube is movable.

9. A lamp socket set comprising the first and second lamp sockets to which the straight tube LED lamp according to claim 1 is attached, wherein the first lamp socket comprises a first cap receiver to which the first cap is attached, and the second lamp socket comprises a second cap receiver to which the second cap is attached.

10. The lamp socket set comprising first and second lamp sockets to which the straight tube LED lamp according to claim 1 is attached, wherein the first lamp socket comprises a first cap receiver to which the first cap is attached, and the second lamp socket comprises a second cap receiver to which the second cap is attached, and each of the first and second lamp sockets comprises an attachment structure to which the straight tube LED lamp is attached by rotating the straight tube LED lamp.

11. A lamp socket set comprising the first and second lamp sockets to which the straight tube LED lamp according to claim 7 is attached, wherein the first lamp socket comprises a first cap receiver to which the first cap is attached, the second lamp socket comprises a second cap receiver to which the second cap is attached, the first cap receiver comprises a rotor that includes an insertion groove into which the first terminal is inserted and that rotates in accordance with rotation of the straight tube, the terminal of the first lamp socket being electrically connected to the first terminal when the rotor rotates, projecting portions are provided in sites of the first lamp socket corresponding to the recessed portions in the first cap, and the second cap receiver is provided with an insertion groove into which the single cap pin constituting the second terminal is inserted, and a grounding contact serving as the terminal of the second lamp socket, which is disposed in the insertion groove and connected to the second terminal, the second terminal being rotatable when in contact with the grounding contact.

12. The lamp socket set comprising the first and second lamp sockets to which the straight tube LED lamp according to claim 1 is attached, wherein the first lamp socket restricts movement of the straight tube LED lamp in a lengthwise direction of the straight tube LED lamp, and the second lamp socket permits movement of the straight tube LED lamp in the lengthwise direction.

13. A lamp socket set comprising the first and second lamp sockets to which the straight tube LED lamp according to claim 1 is attached, wherein the first lamp socket comprises:

an insertion portion into which the first terminal of the straight tube LED lamp can be inserted;

a passage that communicates with the insertion portion, has a narrower width than the latch portions of the first terminal, and has a dimension that allows the first terminal to pass through; and a power feeding contact serving as the terminal of the first lamp socket, which is electrically connected to the first terminal on an outer side of the passage through which the first terminal passes.

14. A lighting fixture comprising:

the lamp socket set including the first and second lamp sockets according to claim 9; and a straight tube LED lamp that is attached to the lamp socket set.

15. A lighting fixture comprising:

the lamp socket set including the first and second lamp sockets according to claim 11; and a straight tube LED lamp that is attached to the lamp socket set.

16. A lighting fixture comprising:

the lamp socket set including the first and second lamp sockets according to claim 12; and a straight tube LED lamp that is attached to the lamp socket set.

17. A lighting fixture comprising:

the lamp socket set including the first and second lamp sockets according to claim 13; and a straight tube LED lamp that is attached to the lamp socket set.

18. The straight lube LED lamp according to claim 1, wherein the terminal of the first lamp socket is a power feeding terminal and the terminal of the second lamp socket is a grounding terminal.

19. A straight lube LED lamp comprising:

a straight tube in which a plurality of light emitting diodes are housed;

a first cap that provides a power feeding connection to the plurality of light emitting diodes, said first cap being provided on one axial direction end side to the straight tube;

a second cap provided on another axial direction end side of the straight tube;

a first terminal that provides an electrical connection to a terminal of a first lamp socket, the first terminal being provided in the first cap; and a second terminal that provides an electrical connection to a terminal of a second lamp socket, the second terminal being provided in the second cap, wherein the second terminal is a single cap pin.

20. The straight tube LED lamp according to claim 19, wherein a tip end of the second terminal is elongated in an attachment direction to the second lamp socket.

21. A lamp socket set comprising first and second lamp sockets to which a straight tube LED lamp is attached, the straight tube LED lamp comprising:

a straight tube in which a plurality of light emitting diodes are housed;

a first cap that provides a power feeding connection to the plurality of light emitting diodes, said first cap being provided on one axial direction end side of the straight tube;

a second cap provided on another axial direction end side of the straight tube;

a first terminal that provides an electrical connection to a terminal of a first lamp socket, the first terminal being provided in the first cap; and a second terminal that provides an electrical connection to a terminal of a second lamp socket, the second terminal being provided in the second cap, wherein the first lamp socket comprises a first cap receiver to which the first cap is attached, and the second lamp socket comprises a second cap receiver to which the second cap is attached, each of the first and second lamp sockets comprises an attachment structure to which the straight tube LED lamp is attached by rotating the straight tube LED lamp, the first cap receiver is provided with a rotor that includes insertion grooves into which two cap pins constituting the first terminal are inserted and that rotates in accordance with rotation of the straight tube, and two power feeding contacts serving as the terminal of the first lamp socket, which arc electrically connected to the cap pins when the rotor rotates, and the second cap receiver is provided with an insertion groove into which a single cap pin constituting the second terminal is inserted, and a grounding contact serving as the terminal of the second lamp socket, which is disposed in the insertion groove and connected to the second terminal, the second terminal being rotatable when in contact with the grounding contact.

22. The lamp socket set according to claim 21, wherein the grounding contact is electrically connected to and mechanically holds the second terminal.

* * * * *